US008641035B2

(12) United States Patent
Kambayashi et al.

(10) Patent No.: US 8,641,035 B2
(45) Date of Patent: Feb. 4, 2014

(54) SHEET CONVEYING APPARATUS, IMAGE READING APPARATUS, AND IMAGE FORMING APPARATUS

(75) Inventors: Mamoru Kambayashi, Tokyo (JP); Hideki Tobinaga, Kanagawa (JP); Shinya Kitaoka, Kanagawa (JP); Atsushi Kanaya, Kanagawa (JP); Norio Kimura, Kanagawa (JP); Michitaka Suzuki, Kanagawa (JP); Yoshito Suzuki, Kanagawa (JP); Kenichiro Morita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/253,303

(22) Filed: Oct. 5, 2011

(65) Prior Publication Data

US 2012/0119432 A1 May 17, 2012

(30) Foreign Application Priority Data

Oct. 7, 2010 (JP) ..... 2010-227655

(51) Int. Cl.
*B65H 3/52* (2006.01)

(52) U.S. Cl.
USPC ..... 271/121; 271/125; 271/265.01

(58) Field of Classification Search
USPC ..... 271/4.03, 4.02, 110, 262, 263, 265.04, 271/121, 122, 125, 4.01, 4.09, 4.1, 167
See application file for complete search history.

(56) References Cited

U.S. PATENT DOCUMENTS 5,029,837 A * 7/1991 Uchiyama ..... 271/110
7,234,695 B2 * 6/2007 Tsukamoto et al. ..... 271/122
7,588,245 B2 * 9/2009 Mandel et al. ..... 271/122
7,938,395 B2 * 5/2011 Yoshida et al. ..... 271/125
2002/0074711 A1 * 6/2002 Higaki ..... 271/117
2004/0217541 A1 * 11/2004 Horio ..... 271/121
2008/0197562 A1 * 8/2008 Yoshida et al. ..... 271/263
2010/0096799 A1 * 4/2010 Shiraiwa et al. ..... 271/111
2010/0102499 A1 * 4/2010 Takamori et al. ..... 271/10.13

FOREIGN PATENT DOCUMENTS

JP 57-141336 * 9/1982
JP 57-189950 * 11/1982
JP 61-166447 * 7/1986
JP 62-31638 * 2/1987
JP 3397606 B2 2/2003
JP 3618898 B2 11/2004
JP 2007-238251 * 9/2007

OTHER PUBLICATIONS

Japanese Patent Publications JP 09-301573 and JP 10-167494.

* cited by examiner

*Primary Examiner* — Thomas Morrison
(74) *Attorney, Agent, or Firm* — Harness, Dickey & Pierce P.L.C.

(57) ABSTRACT

A sheet conveying apparatus includes: a sheet housing unit that houses sheets in a stacked manner; a sheet conveying unit that conveys a sheet to a predetermined conveyance target position; a sheet pick-up unit that picks up outermost one of the sheets housed in the sheet housing unit for conveying to a sheet conveying unit side; a separating and conveying unit that separates the next sheet from the outermost sheet, and conveys only the outermost sheet to the sheet conveying unit; and a sheet-conveyance-movement detecting unit that detects presence or absence of movement of a sheet in the conveying direction. The sheet-conveyance-movement detecting unit is arranged at a position at which the outermost sheet and the next sheet may overlap each other, and a separation portion is located downstream of the pick-up position and is an area where a separation action of the separating and conveying unit works.

12 Claims, 11 Drawing Sheets

SHEET CONVEYING APPARATUS, IMAGE READING APPARATUS, AND IMAGE FORMING APPARATUS

CROSS-REFERENCE TO RELATED APPLICATIONS

The present application claims priority to and incorporates by reference the entire contents of Japanese Patent Application No. 2010-227655 filed in Japan on Oct. 7, 2010.

BACKGROUND OF THE INVENTION

1. Field of the Invention

The present invention relates to a sheet conveying apparatus that separates sheets one by one from a sheet housing unit housing a plurality of sheets and conveys the separated sheet. The present invention also relates to an image reading apparatus and an image forming apparatus that include the sheet conveying apparatus.

2. Description of the Related Art

A conventional image reading apparatus that is used as an image reading unit or a scanner in a copying machine includes an image reading apparatus that reads images by using what is called a sheet-through system, that is, that reads images on sheet originals by using an image reading unit fixed to the apparatus while conveying the sheet originals at a predetermined speed. The sheet-through type image reading apparatus is configured to read images while conveying originals, so that the apparatus of this type has an advantage in increasing the productivity compared to an image reading apparatus that stops originals and performs exposure on the stopped originals (book type).

The sheet-through type image reading apparatus includes an automatic document feeder as a sheet conveying device that conveys sheets one by one from an original table, which is a sheet housing unit on which a plurality of originals is stacked, to a reading position, at which an image reading unit reads images from the originals. The automatic document feeder needs to prevent multiple feeding, in which two originals that are successively conveyed (hereinafter, described as a preceding original and a next original) at least partially overlap each other while continuously reading originals.

Meanwhile, some of the conventional pieces of image reading apparatus include a document conveying unit that conveys originals to the read position; and a pick-up roller as a document pick-up unit that picks up one of the originals placed on the original table and feeds the original toward the document conveying unit. The pick-up roller comes into contact with the top surface of a topmost one of the originals placed at a predetermined position on the original table in the conveying direction and rotates in order to apply a conveying force to the topmost original so that the topmost original is conveyed toward the document conveying unit. Such an automatic document feeder also includes a separating unit that, if a next original is conveyed toward the document conveying unit together with a preceding original and overlaps with the preceding original to which the conveying force is applied by the pick-up roller, separates the next original from the preceding original so that only the preceding original can be conveyed toward the document conveying unit. Multiple feeding is prevented by the separating unit that conveys originals one by one toward the document conveying unit.

Recently, operational efficiency has been required, and demands for an increase in the productivity in the automatic document feeder, i.e., an increase in a document read rate, are more and more increasing.

To ensure a certain level of the productivity in the automatic document feeder, it is necessary to set an interval between the preceding original and the next original that are successively conveyed (hereinafter, described as a sheet interval) to be within a predetermined range. Therefore, there is a known technology for controlling a timing of feeding the next original with reference to a detection signal of a trailing-end detection sensor that detects passage of the trailing end of the preceding original through a predetermined position. As the trailing-end detection sensor, a sensor using a reflective or transmissive photo sensor is known that detects presence or absence of an original by applying light to the surface of the original in order to detect passage of the trailing end of the original through a predetermined position.

However, with the configuration in which the passage of the trailing end of the preceding original through the predetermined position is detected by using the reflective or transmissive photo sensor, if the preceding original and the next original overlap each other at the predetermined position, it is impossible to detect the passage of the trailing end of the preceding original. The reasons will be described below.

The reflective or transmissive photo sensor detects that the original is passing through the predetermined position while detecting reflected light from the original at the predetermined position. After the trailing end of the original passes through the predetermined position, because no light is reflected by the original, the reflective or transmissive photo sensor detects passage of light through the predetermined position, thereby detecting that the trailing end of the original has passed through the predetermined position. With the trailing-end detection sensor using a photo sensor, when the preceding original and the next original overlap each other at, the predetermined position, the next original is present at the predetermined position after the trailing end of the preceding original passes through the predetermined position and light from the photo sensor is reflected by the next original. Therefore, even when the trailing end of the preceding original passes through the predetermined position, the photo sensor detects that the preceding original is passing through the predetermined position and fails to detect that the trailing end of the preceding original has passed through the predetermined position.

In some cases, the next original being conveyed toward the original conveying unit together with the preceding original may be present at the separating unit. Therefore, the configuration in which the trailing-end detection sensor using the reflective or transmissive photo sensor is arranged in the separating unit may be incapable of detecting the trailing end of the preceding original. Consequently, in the conventional technology, it is necessary to arrange the trailing-end detection sensor at a position at which the trailing-end side of the preceding original and the leading-end side of the next original certainly do not overlap each other, e.g., at a position separated from the separating unit by a predetermined distance downstream of the separating unit in the conveying direction. If the trailing-end detection sensor is separated from the separating unit by a predetermined distance downstream of the separating unit in the conveying direction, timing of feeding the next original is delayed by an amount corresponding to the distance, which impedes the high productivity.

To increase the productivity, the trailing-end detection sensor may be arranged at a position at which the passage of the trailing end of the preceding original can be detected at the earliest possible time. A position on the upstream side of the separating unit may be the position at which the passage of the trailing end of the preceding original can be detected at earlier timing than the conventional timing. As a configuration that allows detection of the passage of the trailing end of the preceding original on the upstream side of the separating unit, Japanese Patent No. 3618898 and Japanese Patent No. 3397606 disclose a configuration in which a roller member is provided that comes into contact with the top surface of originals stacked on a original table and a change in the speed of the roller member is detected in order to detect passage of the trailing end of the preceding original. This configuration can be regarded as valuable in detecting the presence or absence of movement of an original in the conveying direction so as to detect passage of the trailing end of the preceding original.

However, in the configuration disclosed in Japanese Patent No. 3618898 and Japanese Patent No. 3397606, the roller member that comes into contact with the top surface of the originals on the original table protrude on the upstream side of the pick-up roller. Therefore, there is a problem in that such a configuration is not practically useful because the original setting capability of the original table may be largely reduced and the operability may be reduced accordingly.

In view of this, there is a demand for an automatic document feeder that can detect passage of the trailing end of the preceding original through a predetermined position at earlier timing and that can increase the productivity without, reducing the operability.

The demand for detection of the passage of the trailing end of the preceding original through a predetermined position at earlier timing is not limited to the automatic document feeder. In any sheet conveying devices that convey sheets one by one from a sheet housing unit housing a plurality of sheets to a conveyance target position, it is needed to detect passage of the trailing end of the preceding original through a predetermined position at earlier timing and increase the productivity.

SUMMARY OF THE INVENTION

It is an object of the present invention to at least partially solve the problems in the conventional technology.

According to an aspect of the present invention, there is provided a sheet conveying apparatus including: a sheet housing unit that houses a plurality of sheets in a stacked manner; a sheet conveying unit that conveys a sheet to a predetermined conveyance target position; a sheet pick-up unit that picks up, at a pick-up position, outermost one of the sheets housed in the sheet housing unit by applying a conveying force to the outermost sheet for conveying the outermost sheet to a sheet conveying unit side; a separating and conveying unit that, when a next sheet is conveyed to the sheet conveying unit and overlaps with the outermost sheet to which the conveying force is applied by the sheet pick-up unit, separates the next sheet from the outermost sheet by applying a conveying force in a direction opposite to a sheet conveying direction to the next sheet or by applying a stopping force to the next sheet, and conveys only the outermost sheet to the sheet conveying unit; and a sheet-conveyance-movement detecting unit that detects presence or absence of movement of a sheet in the conveying direction. The sheet-conveyance-movement detecting unit is arranged at a position, which is the same as or near a position of a separation portion in the conveying direction and at which the outermost sheet and the next sheet may overlap each other, the separation portion being located downstream of the pick-up position and being an area where a separation action of the separating and conveying unit works.

According to another aspect of the present invention, there is provided an image reading apparatus including: a sheet conveying apparatus that includes: a sheet housing unit that houses a plurality of sheets in a stacked manner; a sheet conveying unit that conveys a sheet to a predetermined conveyance target position; a sheet pick-up unit that picks up, at a pick-up position, outermost one of the sheets housed in the sheet housing unit by applying a conveying force to the outermost sheet for conveying the outermost sheet to a sheet conveying unit side; a separating and conveying unit that, when a next sheet is conveyed to the sheet conveying unit and overlaps with the outermost sheet to which the conveying force is applied by the sheet pick-up unit, separates the next sheet from the outermost sheet by applying a conveying force in a direction opposite to a sheet conveying direction to the next sheet or by applying a stopping force to the next sheet, and conveys only the outermost sheet to the sheet conveying unit; and a sheet-conveyance-movement detecting unit that detects presence or absence of movement of a sheet in the conveying direction. The sheet-conveyance-movement detecting unit is arranged at a position, which is the same as or near a position of a separation portion in the conveying direction and at which the outermost sheet and the next sheet may overlap each other, the separation portion being located downstream of the pick-up position and being an area where a separation action of the separating and conveying unit works.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments, in which the present invention is applied to an electrophotographic copying machine (hereinafter, simply described as a copying machine 500), will be explained below.

A basic configuration of the copying machine 500 according to an embodiment of the present invention will be described first.

Figure 2:
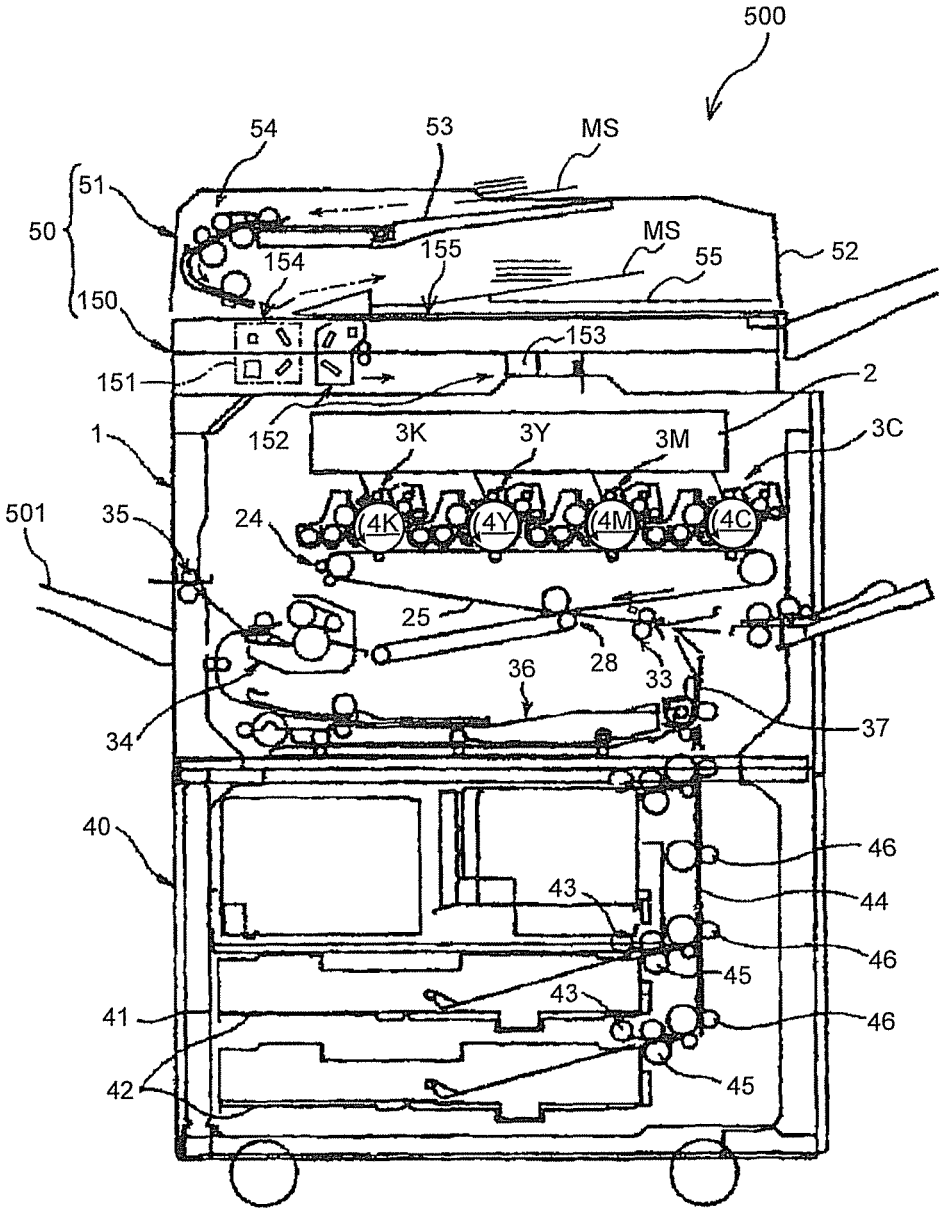
FIG. 2 is a schematic configuration diagram of a copying machine according to the embodiment.

FIG. 2 is a schematic configuration diagram of the copying machine 500. The copying machine 500 includes an image forming unit 1 as an image forming means, a transfer-sheet feeding device 40, and an image reading unit 50. The image reading unit 50 as an image reading apparatus includes a scanner 150 that is fixed on the image forming unit 1; and an automatic document feeder (hereinafter, described as an ADF) 51 as a sheet conveying apparatus that is supported by the scanner 150.

The transfer-sheet feeding device 40 includes two transfer-sheet feed cassettes 42 that are arranged in a multi-stage manner in a paper bank 41; transfer-sheet output rollers 43 that output transfer sheets P from the transfer-sheet feed cassettes 42; and transfer-sheet separation rollers 45 that separate the output transfer sheets P and supply the sheet to a transfer-sheet feed path 44. The transfer-sheet feeding device 40 also includes a plurality of conveying rollers 46 that conveys the transfer sheet P as a sheet member to a main-body-side sheet feed path 37 as a feed path of the image forming unit 1. With this configuration, the transfer sheet P in the transfer-sheet feed cassettes 42 is fed to the main-body-side sheet feed path 37 in the image forming unit 1.

The image forming unit 1 includes an optical writing device 2; four process units 3K, 3Y, 3M, and 3C that form toner images of black, yellow, magenta, and cyan (K, Y, M, and C), respectively; a transfer unit 24; a sheet conveying unit 28; a registration roller pair 33; a fixing device 34; a switch-back device 36; and the main-body-side sheet feed path 37. A light source (not illustrated), such as a laser diode or an LED, arranged in the optical writing device 2 is driven to apply light L to four drum-shaped photosensitive elements 4K, 4Y, 4M, and 4C. With this irradiation, electrostatic latent images are formed on the respective surfaces of the photosensitive elements 4K, 4Y, 4M, and 4C, and the latent images are developed into toner images through a predetermined developing process.

Figure 3:
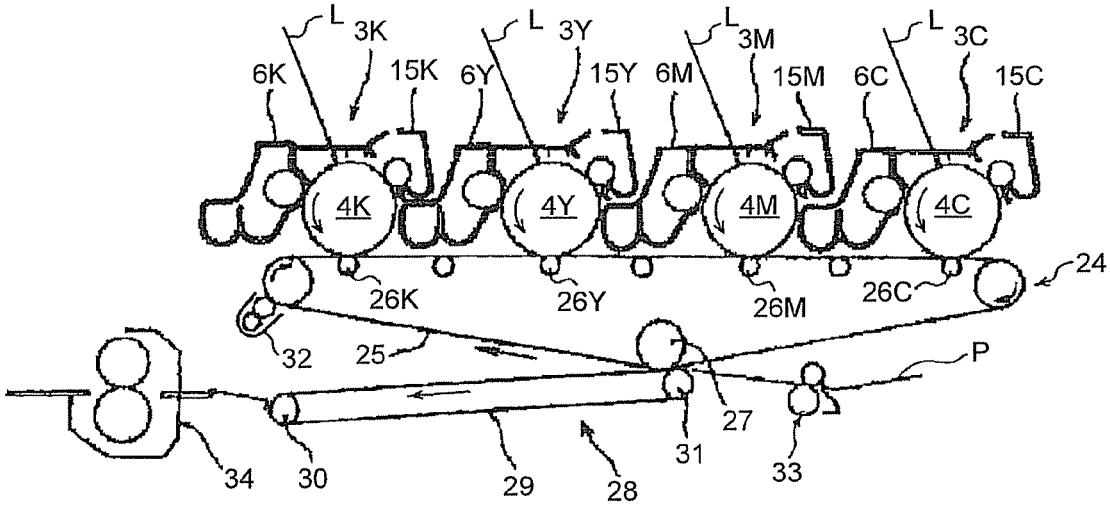
FIG. 3 is an enlarged configuration diagram of a part of an image forming unit of the copying machine.
Figure 4:
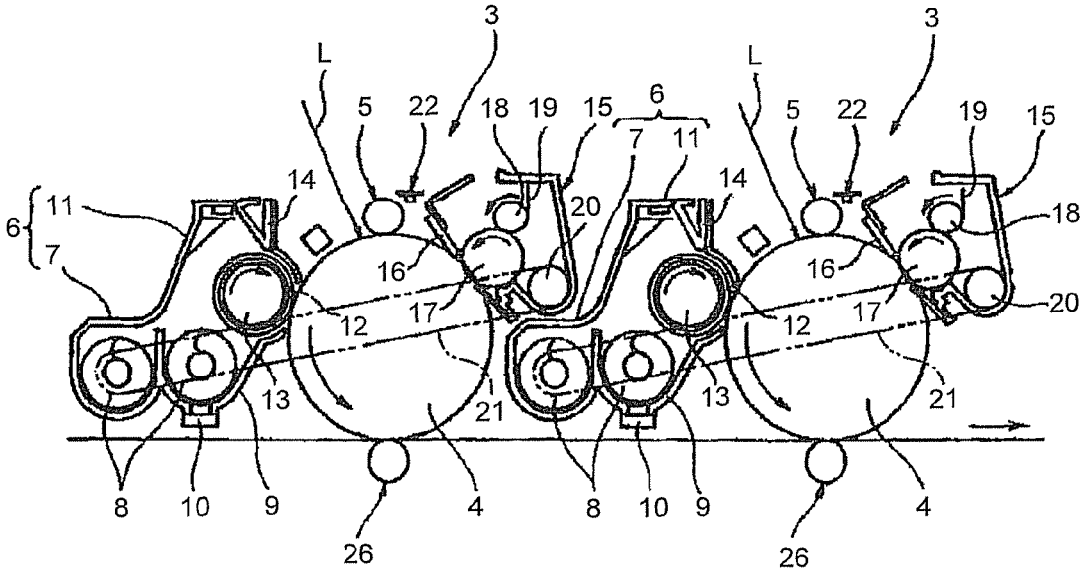
FIG. 4 is a partially enlarged view of a part of a tandem unit that includes four process units in the image forming unit.

FIG. 3 is an enlarged schematic diagram of a part of the internal configuration of the image forming unit 1. FIG. 4 is a partially enlarged view of a tandem unit that includes the four process units 3K, 3Y, 3M, and 3C. The four process units 3K, 3Y, 3M, and 3C have substantially the same configurations except for colors of toner to be used. Therefore, alphabets K, Y, M, and C added to the reference numerals are omitted in FIG. 4.

Each of the process units 3K, 3Y, 3M, and 3C is one unit that includes a photosensitive element 4 and various devices arranged around the photosensitive element and that is supported by a common supporting member. The process units 3K, 3Y, 3M, and 3C are detachably attached to the image forming unit 1 that is a main body of the copying machine 500. Each of the process units 3 includes a charging device 5 (one of 5K, 5Y, 5M, and 5C), a developing device 6 (one of 6K, 6Y, 6M, and 6C), a drum cleaning device 15 (one of 15K, 15Y, 15M, and 15C), a neutralizing lamp 22, and the like around the photosensitive element 4. The copying machine 500 has what is called a tandem structure, in which the four process units 3K, 3Y, 3M, and 3C are arranged opposite to an intermediate transfer belt 25 and side by side in a direction of endless movement of the intermediate transfer belt 25, which will be described below.

As the photosensitive element 4, a drum-shaped member formed of, for example, an aluminum tube coated with a photosensitive layer that is made of an organic photosensitive material having photosensitivity is used. However, an endless belt may be used as the photosensitive element.

The developing device 6 develops an electrostatic latent image by using two-component developer containing magnetic carrier and non-magnetic toner, which are not illustrated. The developing device 6 includes a stirring unit 7 that supplies a developing sleeve 12 with the two-component developer contained therein while stirring the two-component developer; and a developing unit 11 that transfers toner contained in the two-component developer carried on the developing sleeve 12 to the photosensitive element 4.

The stirring unit 7 is arranged at a lower position than the developing unit 11. The stirring unit 7 includes two conveying screws 8 that are arranged parallel to each other; a partition plate arranged between the two conveying screws 8; and a toner concentration sensor 10 that is arranged on the bottom surface of a developing case 9.

The developing unit 11 includes the developing sleeve 12 that is arranged opposite to the photosensitive element 4 through an opening of the developing case 9; a magnet roller 13 that is non-rotatably arranged inside the developing sleeve 12; and a doctor blade 14 whose tip comes close to the developing sleeve 12. The developing sleeve 12 is a non-magnetic rotatable cylinder. The magnet roller 13 includes a plurality of magnetic poles that are sequentially arranged, from a position opposing to the doctor blade 14, in the rotation direction of the developing sleeve 12. Each of the magnetic poles exerts a magnetic force on the two-component developer on the developing sleeve 12 at a predetermined position in the rotation direction. Therefore, the two-component developer conveyed from the stirring unit 7 is attracted to the surface of the developing sleeve 12 and carried thereon, and a magnetic brush is formed along a line of the magnetic force on the surface of the developing sleeve 12.

The magnetic brush is regulated to an appropriate thickness when the magnetic brush passes through a position opposing to the doctor blade 14 along with the rotation of the developing sleeve 12 and thereafter conveyed to a developing area opposing to the photosensitive element 4. The magnetic brush contributes to the development by transferring toner onto an electrostatic latent image due to a potential difference between a developing bias voltage applied to the developing sleeve 12 and the electrostatic latent image on the photosensitive element 4. The two-component developer that forms the magnetic brush and that passes through the developing area while being carried on the developing sleeve 12 is returned to the inside of the developing unit 11 along with the rotation of the developing sleeve 12, is removed from the surface of the developing sleeve 12 by the influence of the repelling magnetic field generated between the magnetic poles of the magnet roller 13, and thereafter returned to the stirring unit 7. An appropriate amount of toner is supplied to the two-component developer in the stirring unit 7 on the basis of a detection result of the toner concentration sensor 10. As the developing device 6, a device that uses one-component developer which does not contain magnetic carrier, instead of the two-component developer, may be employed.

The drum cleaning device 15 employs a system in which a cleaning blade 16 made of an elastic material is pressed against the photosensitive element 4; however, another system may be employed. In the embodiment, to increase the cleaning performance, a system is employed that includes a contact conductive fur brush 17 whose outer periphery is brought into contact with the photosensitive element 4 and which is rotatable in the direction of an arrow in FIG. 4. The fur brush 17 also has a function to scoop a lubricant from a solid lubricant (not illustrated), reduce the lubricant to fine powders, and apply the lubricant powder to the surface of the photosensitive element 4. The drum cleaning device 15 includes a metallic electric-field roller 18 that applies a bias voltage to the fur brush 17 and that is rotatable in the direction of an arrow; and a scraper 19 whose tip is pressed against the electric-field roller 18. Toner attached to the fur brush 17 is transferred to the electric-field roller 18 which comes into contact with the fur brush 17 while rotating in the opposite direction and to which a bias voltage is applied. The toner is scraped from the electric-field roller 18 by the scraper 19 and falls on a collection screw 20. The collection screw 20 conveys the collected toner in the direction perpendicular to the sheet of FIG. 4 toward an end of the drum cleaning device 15 and transfers the collected toner to an external recycle conveying device 21. The recycle conveying device 21 conveys the received collected toner to the developing device 6 so as to recycle the toner.

The neutralizing lamp 22 neutralizes the surface of the photosensitive element 4 by applying light. The surface of the photosensitive element 4 having been neutralized is uniformly charged by the charging device 5 and thereafter subjected to an optical writing process by the optical writing device 2. In the copying machine 500, the charging device 5 is configured such that a charging roller to which a charging voltage is applied is rotated while being brought into contact with the photosensitive element 4. However, it is possible to use a scorotron charger or the like that performs non-contact charging process on the photosensitive element 4.

In FIG. 3 described above, toner images of K, Y, M, and C are formed on the photosensitive elements 4K, 4Y, 4M, and 4C in the four process units 3K, 3Y, 3M, and 3C, respectively, through the processes described above.

The transfer unit 24 is arranged below the four process units 3K, 3Y, 3M, and 3C. The transfer unit 24 causes the intermediate transfer belt 25, which is stretched around a plurality of rollers, to endlessly move in a clockwise direction in the figure while bringing the intermediate transfer belt 25 into contact with the photosensitive elements 4K, 4Y, 4M, and 4C. Consequently, primary transfer nips for K, Y, M, and C are formed at respective contact positions between the photosensitive elements 4K, 4Y, 4M, and 4C and the intermediate transfer belt 25. Near the primary transfer nips for K, Y, M, and C, the intermediate transfer belt 25 is pressed against the photosensitive elements 4K, 4Y, 4M, and 4C by primary transfer rollers 26K, 26Y, 26M, and 26C that are arranged to stretch the intermediate transfer belt from inside. A primary transfer bias voltage is applied to each of the primary transfer rollers 26K, 26Y, 26M, and 26C by a power supply (not illustrated). Therefore, a primary transfer electric field for electrostatically transferring the toner image from the photosensitive element 4K, 4Y, 4M, or 4C to the intermediate transfer belt 25 is formed in each of the primary transfer nips for K, Y, M, and C. On the outer surface of the intermediate transfer belt 25 that passes through the primary transfer nips for K, Y, M, and C in sequence along with the endless movement in the clockwise direction in the figure, toner images are sequentially superimposed one on top of the other through the primary transfer process at the primary transfer nips. By the superimposition through the primary transfer process, a toner image (hereinafter, described as a four-color toner image) in which four colors are superimposed is formed on the outer surface of the intermediate transfer belt 25.

The sheet conveying unit 28, in which an endless sheet feed belt 29 is stretched and endlessly moved between a driving roller 30 and a secondary transfer roller 31, is arranged below the transfer unit 24 in the figure. The intermediate transfer belt 25 and the sheet feed belt 29 are sandwiched by the secondary transfer roller 31 and a lower tension roller 27, that is a tension roller provided in the lower side, of the transfer unit 24. Accordingly, a secondary transfer nip is formed, in which the outer surface of the intermediate transfer belt 25 and the outer surface of the sheet feed belt 29 are in contact with each other. A secondary transfer bias voltages is applied to the secondary transfer roller 31 by a power supply (not illustrated). On the other hand, the lower tension roller 27 of the transfer unit 24 is grounded. Consequently, a secondary-transfer electric field is formed in the secondary transfer nip.

The registration roller pair 33 is arranged on the right side of the secondary transfer nip in the figure. A registration roller sensor (not illustrated) is arranged near an entrance to a registration nip of the registration roller pair 33. The registration roller sensor (not illustrated) detects a leading end of the transfer sheet P conveyed from the transfer-sheet feeding device 40 toward the registration roller pair 33, and after a predetermined period of time elapses since the detection of the leading end by the registration sensor, the conveyance of the transfer sheet P is temporarily suspended in a state where the leading end of the transfer sheet P abuts on the registration nip of the registration roller pair 33. Consequently, the posture of the transfer sheet P is adjusted and setting up of the synchronization with image formation becomes ready.

When the leading end of the transfer sheet P abuts on the registration nip, the registration roller pair 33 resumes the rotation of the rollers at timing at which the transfer sheet P can be synchronized with the four-color toner image on the intermediate transfer belt 25, so that the transfer sheet P is output toward the secondary transfer nip. In the secondary transfer nip, the four-color toner image on the intermediate transfer belt 25 is secondary transferred collectively onto the transfer sheet P due to the secondary-transfer electric field and a nip pressure. Accordingly, a full-color image is formed on the transfer sheet P with the aid of a white background of the transfer sheet P. The transfer sheet P that passes through the secondary transfer nip is separated from the intermediate transfer belt 25 while being carried on the outer surface of the sheet feed belt 29 and thereafter conveyed toward the fixing device 34 along with the endless movement of the sheet feed belt 29.

Residual toner, which is not transferred onto the transfer sheet P at the secondary transfer nip, remains on the outer surface of the intermediate transfer belt 25 that has passed through the secondary transfer nip. The residual toner is scraped and removed by a belt cleaning device 32 that includes a cleaning member abutting on the intermediate transfer belt 25.

In the fixing device 34, pressure and heat are applied to fix the full-color image to the transfer sheet P conveyed to the fixing device 34, and thereafter the transfer sheet P is conveyed from the fixing device 34 to a discharge roller pair 35 that discharges the transfer sheet P to a discharge tray 501 arranged outside the copying machine.

In FIG. 2 described above, the switchback device 36 as a transfer-sheet reversing device is arranged below the sheet conveying unit 28 and the fixing device 34. When duplex printing is performed, the conveying path of the transfer sheet P for which an image fixation process on one side is completed is switched to the switchback device 36 side by a switching claw, and the transfer sheet P is reversed and re-enters the secondary transfer nip. The secondary transfer process and the fixation process for an image are performed on the other side of the transfer sheet P and then the transfer sheet P is discharged to the discharge tray 501.

The image reading unit 50 that includes the scanner 150 fixed on the image forming unit 1 and the ADF 51 fixed on the scanner 150 further includes two fixed reading units and a movable reading unit 152, which will be described below. The movable reading unit 152 is arranged immediately below a second contact glass 155 that is fixed to an upper wall of a casing of the scanner 150 so as to come into contact with an original MS. The movable reading unit 152 can move an optical system including a light source, reflecting mirrors, and the like in the horizontal direction in the figure. When the optical system is moved from the left side to the right side, light emitted from the light source is reflected by a bottom surface of the original MS placed on the second contact glass 155 and is received by an image reading sensor 153 fixed to the scanner 150 via a plurality of reflecting mirrors.

The image reading unit 50 includes, as fixed reading units, a first fixed reading unit 151 arranged inside the scanner 150 and a second fixed reading unit 95 arranged inside the ADF 51, which will be described below. The first fixed reading unit 151 includes a light source, reflecting mirrors, an image reading sensor, such as a charge coupled device (CCD), and the like and is arranged immediately below a first contact glass 154 that is fixed to an upper wall of the casing of the scanner 150 so as to come into contact with the original MS. When the original MS that is conveyed by the ADF 51 passes on the first contact glass 154, the light source emits light so that the light is sequentially reflected by a first surface of the original MS and received by the image reading sensor 153 via a plurality of reflecting mirrors. Consequently, the first surface of the original MS is scanned without moving the optical system including the light source, the reflecting mirrors, and the like. The second fixed reading unit 95 scans a second surface of the original MS after the original MS passes through the first fixed reading unit 151.

The ADF 51 arranged on the scanner 150 includes, on a main-body cover 52, an original support plate 53 for placing the original MS before reading; an original conveying unit 54 for conveying the original MS as a sheet material; and an original stacking board 55 for stacking the original MS after reading.

Figure 5:
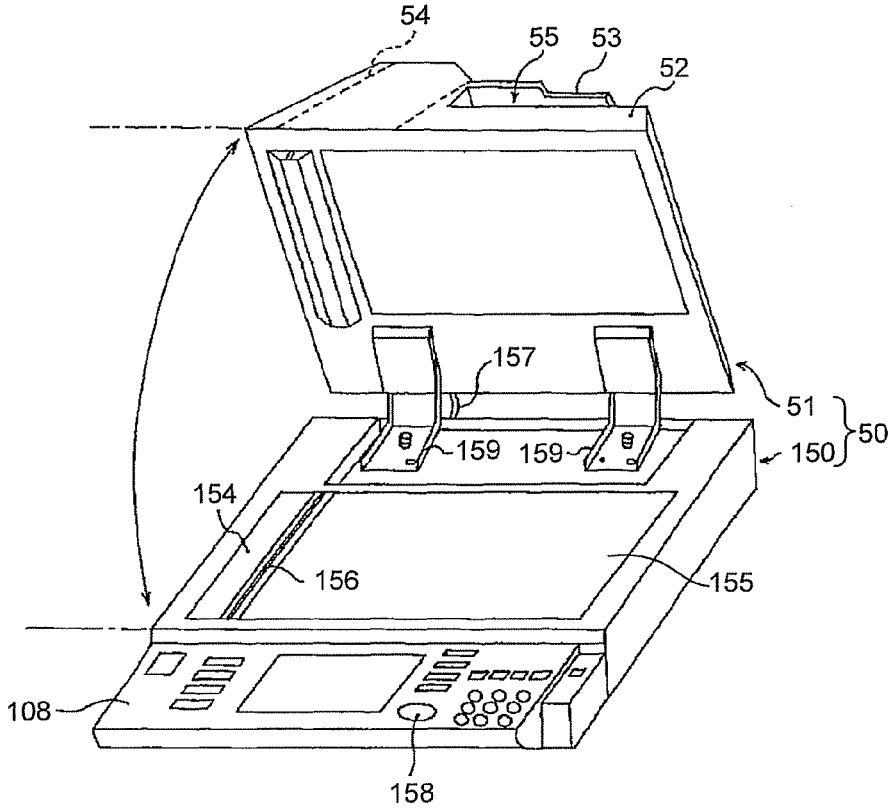
FIG. 5 is a perspective view of the scanner and the ADF of the copying machine.

FIG. 5 is a perspective view of the image reading unit 50. As illustrated in FIG. 5, the ADF 51 is supported by hinges 159 fixed to the scanner 150 so that the ADF 51 can swing in the vertical direction. The ADF 51 moves like a swing door by the swing so that the first contact glass 154 and the second contact glass 155 on the top surface of the scanner 150 are exposed while the ADF 51 is opened. The ADF 51 cannot convey a bound original, in which originals are stacked and bound at one side thereof like a book, because such originals cannot be separated one by one. Therefore, when the bound original is to be read, the ADF 51 is opened as illustrated in the figure, the bound original is placed on the second contact glass 155 with a page to be read facing down, and then the ADF 51 is closed. Thereafter, the movable reading unit 152 of the scanner 150 illustrated in FIG. 2 reads the page.

When a stack of originals, in which separate originals MS are simply stuck one on top of the other, is to be read, the ADF 51 automatically conveys the originals MS one by one and the first fixed reading unit 151 in the scanner 150 and the second fixed reading unit 95 in the ADF 51 sequentially read the originals. In this case, when the stack of the originals is set on the original support plate 53 and then a copy start button 158 of an operating unit 108 is pressed, the ADF 51 sequentially feeds the originals MS from the top of the stack of the originals placed on the original support plate 53 to the original conveying unit 54 and then the original is reversed and conveyed toward the original stacking board 55. During the conveyance, the original MS is guided to pass immediately above the first fixed reading unit 151 in the scanner 150 immediately after the original MS is reversed. At this time, the first fixed reading unit 151 of the scanner 150 reads an image on the first surface of the original MS.

The ADF 51 will be explained below.

Figure 1:
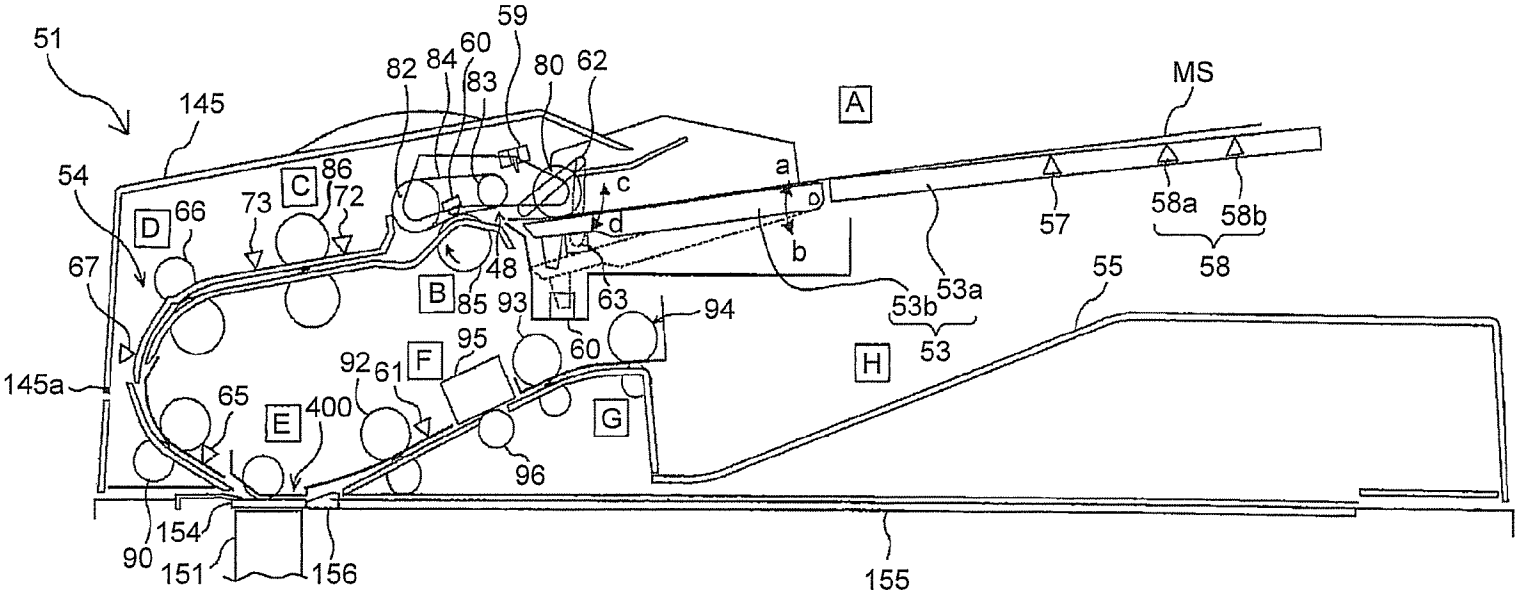
FIG. 1 is a schematic configuration diagram of an ADF and an upper portion of a scanner according to an embodiment of the present invention.

FIG. 1 is an enlarged configuration diagram of a main part of the ADF 51 and the upper portion of the scanner 150. The ADF 51 includes an original set unit A, a separating and conveying unit B, a registration unit C, a turning unit D, a first reading and conveying unit E, a second reading and conveying unit F, a discharging unit G, and a stacking unit H. The original conveying unit 54 of the ADF 51 of the embodiment corresponds to a section that forms a pathway along which the original MS is conveyed from a detection position of an abutting sensor 72 on the downstream side of the separating and conveying unit B in the conveying direction to a read entrance roller pair 90.

The ADF 51 includes a feeding-unit cover 145 that rotates about a cover rotation center 145*a* with respect to the main body of the apparatus and that exposes and shields a feed path in the separating and conveying unit B, the registration unit C, and a part of the feed path in the turning unit D.

The original set unit A includes the original support plate 53 on which a stack of the originals MS is set with the first surface facing up. The separating and conveying unit B separates the originals MS one by one from the stack of the set originals MS and feeds the separated original. The registration unit C temporarily abuts on the fed original MS to align the original MS, and pulls out and conveys the aligned original MS. The turning unit D has a curved conveying unit that is curved in a C shape, and reverses the original MS while the original MS is conveyed along the curved conveying unit so that the first surface of the original MS faces down. The first reading and conveying unit E causes the first fixed reading unit 151 in the scanner 150 to read the first surface of the original MS from below the first contact glass 154 while conveying the original MS on the first contact glass 154. The second reading and conveying unit F causes the second fixed reading unit 95 to read the second surface of the original MS while conveying the original MS by using a second read roller 96 that is arranged below the second fixed reading unit 95. The discharging unit G discharges the original MS, from which images on the both sides have been read, toward the stacking unit H. The stacking unit H stacks and holds the originals MS on the original stacking board 55 after the reading.

Figure 6:
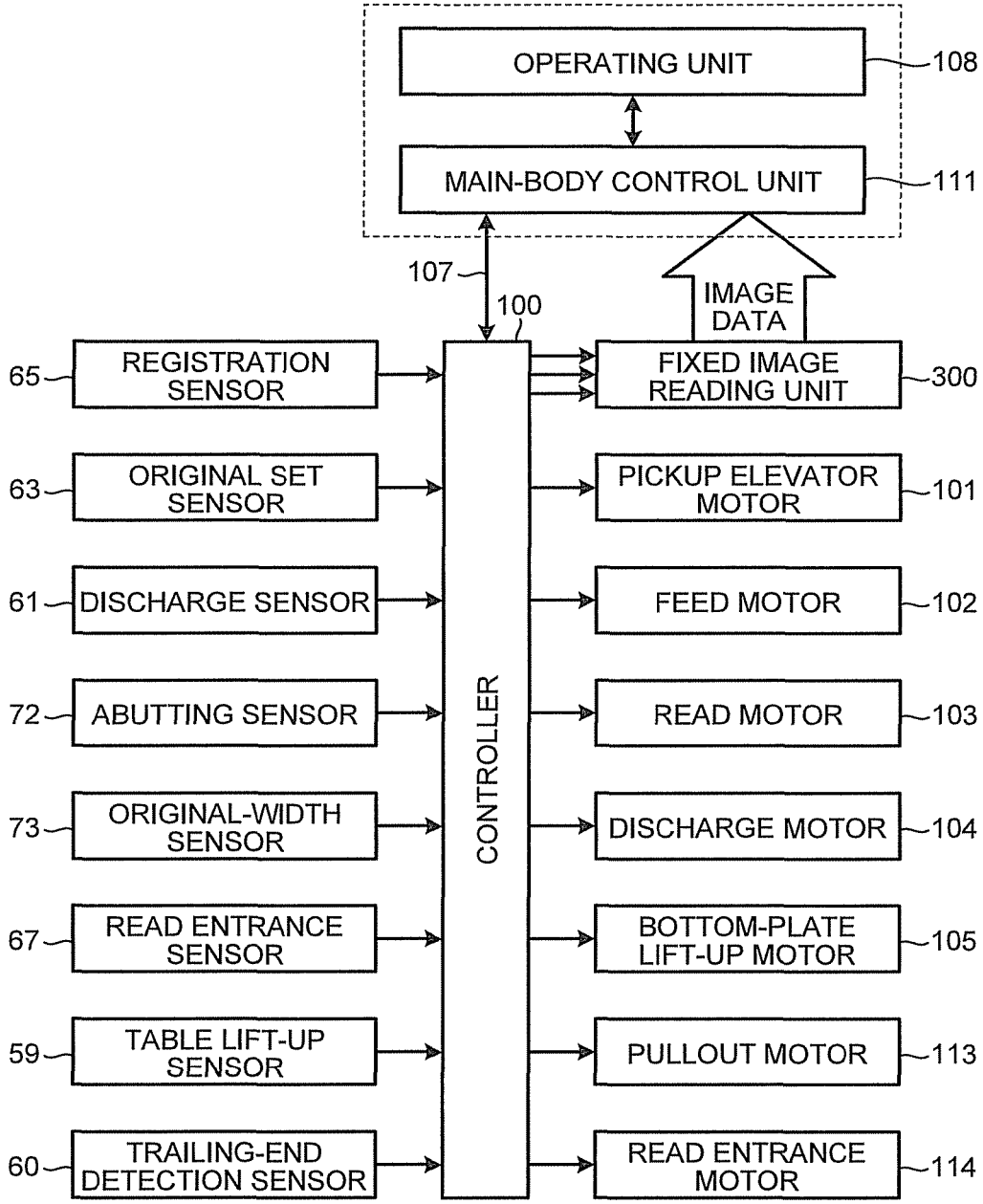
FIG. 6 is an overall control block diagram of the ADF.

FIG. 6 is an overall control block diagram of the ADF 51. A control unit of the ADF 51 includes motors 101 to 105, 113, and 114, which are driving units for driving operations of conveying originals; various sensor units; a fixed image reading unit 300 (the first fixed reading unit 151 or the second fixed reading unit 95); and a controller 100 that controls a series of operations.

Figure 7:
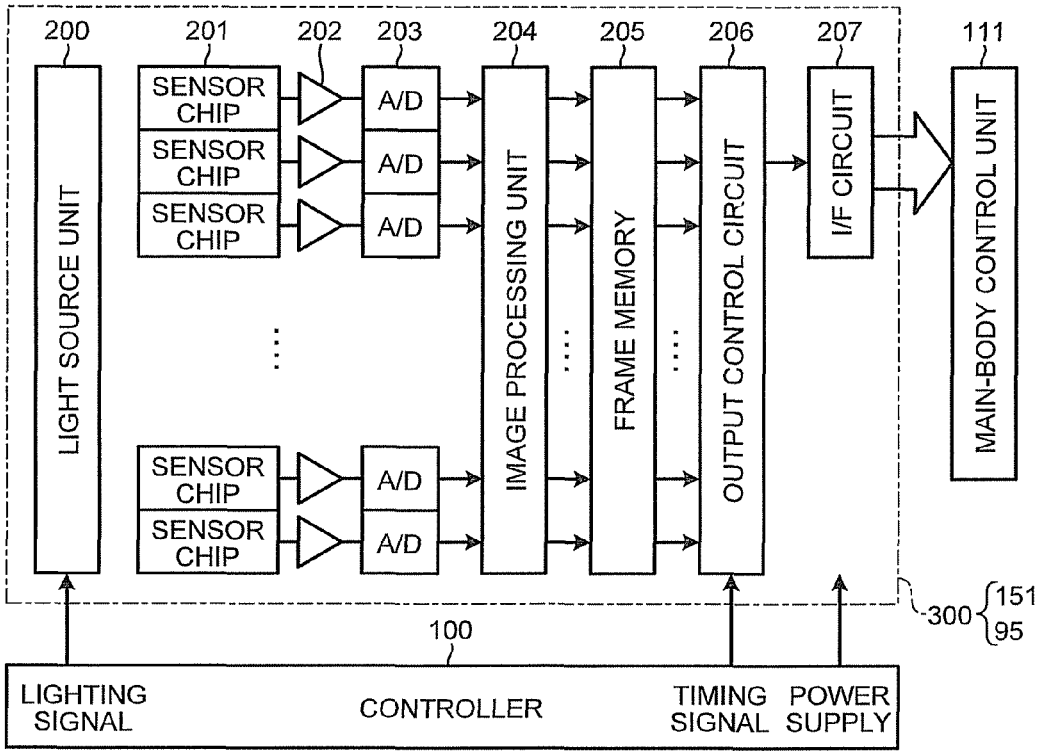
FIG. 7 is a control block diagram of a fixed image reading unit.

FIG. 7 is a control block diagram of the fixed image reading unit 300. The fixed image reading unit 300 includes a light source unit 200, sensor chips 201, amplifiers 202, analogdigital (A/D) converters 203, an image processing unit 204, a frame memory 205, an output control circuit 206, I/F circuit 207, and the like.

A stack of originals MS to be read is set on the original support plate 53 such that the first surfaces face up. The original support plate 53 includes a movable original table 53*b* that supports leading-end portions of the originals and that is movable in directions indicated by arrows a and b in FIG. 1 in accordance with the thickness of the stack of the originals MS; and a fixed original table 53*a* that supports trailing-end sides of the originals. When the originals MS are set on the original support plate 53, side guides (not illustrated) abut on the both edges of the originals in the width direction (a direction perpendicular to the conveying direction of the original MS, i.e., a direction perpendicular to the page of FIG. 1), so that the positions of the originals MS in the width direction can be set.

The originals MS set on the original support plate 53 as above push up a set filler 62, which is a lever member that can swing and is arranged above the movable original table 53*b*. Accordingly, an original set sensor 63 detects that the originals MS are set and transmits detection signal to the controller 100. The detection signal is transmitted from the controller 100 to a main-body control unit 111 of the image reading unit 50 via an interface circuit (hereinafter, described as an I/F 107).

A plurality of original-length sensors 57 and 58 (58*a*, 58*b*), each of which may be a reflective photo sensor that detects the lengths of the originals MS in the conveying direction or an actuator-type sensor that can detect even one original, are arranged to the fixed original table 53*a*. With these original-length sensors, the approximate lengths of the originals MS in the conveying direction are determined (the sensors need to be arranged such that at least a longitudinal side or a lateral side of an original of the same size can be determined).

A pick-up roller 80 is arranged above the movable original table 53*b*. The pick-up roller 80 receives a driving force transmitted from the feed motor 102 and rotates together with a feed belt 84 and a reverse roller 85 that form a separation nip as a separating unit.

The movable original table 53*b* is caused to swing in the directions indicated by the arrows a and b in FIG. 1 by a cam mechanism that is driven by the bottom-plate lift-up motor 105. When the set filler 62 or the original set sensor 63 detects that the originals MS are set on the original support plate 53, the controller 100 rotates the bottom-plate lift-up motor 105 in the forward direction to lift up the movable original table 53*b* so that the topmost surface of the stack of the originals MS comes into contact with the pick-up roller 80.

The pick-up roller 80 is movable in directions indicated by arrows c and d in FIG. 1 with the aid of a cam mechanism that is driven by the pick-up elevator motor 101. When the movable original table 53*b* is lifted up, the pick-up roller 80 moves upward in the direction indicated by the arrow c in the figure by being pushed by the top surface of the originals MS on the movable original table 53*b*. When the movement of the pick-up roller 80 is detected by a table lift-up sensor 59, it is detected that the movable original table 53*b* is lifted up to reach the upper limit. Accordingly, the pick-up elevator motor 101 and the bottom-plate lift-up motor 105 are stopped to move.

When the copy start button 158 is pressed via the operating unit 108, an original feed signal is transmitted from the main-body control unit 111 to the controller 100 that is the control unit of the ADF 51 via the I/F 107. Accordingly, the feed motor 102 is driven to rotate the pick-up roller 80, so that a few originals MS (ideally one original) on the original support plate 53 are picked up. The rotation direction of the pick-up roller 80 is the direction in which the topmost original MS is conveyed to a feed port 48.

The originals MS fed by the pick-up roller 80 enter the separating and conveying unit B and conveyed to a position of contact with the feed belt 84. The feed belt 84 is stretched between a driving roller 82 and a driven roller 83 and endlessly moves in the clockwise direction in FIG. 1 by being driven by the rotation of the driving roller 82 in association with the forward rotation of the feed motor 102.

The reverse roller 85 that rotates in the clockwise direction in the figure along with the forward rotation of the feed motor 102 comes into contact with the lower-side stretched surface of the feed belt 84. At the separation nip being the contact portion, the surface of the feed belt 84 moves in the feed direction. On the other hand, the surface of the reverse roller 85 moves in the direction opposite to the feed direction. However, a torque limiter (not illustrated) is arranged in a drive transmitting unit of the reverse roller 85 and when the force in the feed direction becomes greater than the torque of the torque limiter, the reverse roller 85 rotates so that the surface of the reverse roller 85 moves in the feed direction.

The reverse roller 85 comes into contact with the feed belt 84 at a predetermined pressure, and while directly coming into contact with the feed belt 84, or while coming into contact with the feed belt 84 by interposing only one original MS (while one original MS is sandwiched at the separation nip), the reverse roller 85 rotates along with the feed belt 84 or the original MS in the counterclockwise direction in FIG. 1. However, when a plurality of originals MS are sandwiched at the separation nip, because a rotationally driven force of the reverse roller 85 is set to be smaller than the torque of the torque limiter, the reverse roller 85 rotates in the clockwise direction in the figure, which is opposite to a rotationally driven direction. Therefore, the reverse roller 85 applies a moving force in the direction opposite to the feed direction to the originals MS below the topmost original, so that only the topmost original MS is separated from the originals and multiple feeding can be prevented.

The one original MS separated by the action of the feed belt 84 and the reverse roller 85 enters the registration unit C. The original MS is further conveyed by the feed belt 84, the leading end of the original MS is detected by the abutting sensor 72, and the original MS is further conveyed and abuts on a pullout roller pair 86 (86*a*, 86*b*) that is being stopped. At this time, the feed motor 102 that is in operation is driven for a predetermined period of time after the detection of the leading end of the original MS by the abutting sensor 72 and then the feed motor 102 is stopped. Accordingly, the original MS is conveyed a predetermined distance from the detection position of the abutting sensor 72, and thereafter, the feed belt 84 stops the conveyance of the original MS while the original MS is abutting on the pullout roller pair 86 with a predetermined amount of bent.

By rotating the pick-up elevator motor 101 when the abutting sensor 72 detects the leading end of the original MS, the pick-up roller 80 is evacuated from the top surface of the original MS and the original MS is conveyed only by a conveying force of the feed belt 84. Consequently, the leading end of the original MS enters a nip formed between upper and lower rollers of the pullout roller pair 86 and the leading end is aligned (skew correction).

The pullout roller pair 86 is a roller pair that has a skew correction function as described above and that conveys the original MS, which is separated and then subjected to the skew correction, to an intermediate roller pair 66. With operation of the pullout motor 113, one of the two rollers of the pullout roller pair 86 rotates.

The feed motor 102 may be used as a driving source of the pullout roller pair 86. In this case, when the feed motor 102 rotates in the forward direction, a driving force is transmitted to the pick-up roller 80, the feed belt 84, and the reverse roller 85, and, when the feed motor 102 rotates in the reverse direction, the driving force is transmitted to the pullout roller pair 86. However, as described in the embodiment, if the pullout roller pair 86 is driven by the pullout motor 113 that is an independent drive mechanism, it is possible to reduce the start-up time and the stopping time of the motor, enabling to increase the productivity.

The original MS fed by the pullout roller pair 86 passes immediately below an original-width sensor 73. The original-width sensor 73 includes a plurality of sheet detection sensors, formed by reflective photo sensors and the like, arranged in the original-width direction (the direction perpendicular to the page of FIG. 1). The original-width sensor 73 detects the size of the original MS in the width direction by identifying a sheet detection sensor that has detected the original MS. The length of the original MS in the conveying direction is detected from a motor pulse on the basis of duration from when the abutting sensor 72 detects the leading end of the original MS to when the abutting sensor 72 completes detection of the original MS (the trailing end of the original MS passes through the abutting sensor).

The original MS conveyed by the rotation of the pullout roller pair 86 and the intermediate roller pair 66 enters the turning unit D in which the original MS is conveyed by the intermediate roller pair 66 and the read entrance roller pair 90.

The intermediate roller pair 66 receives a driving force from the pullout motor 113, which is a driving source of the pullout roller pair 86, and from the read entrance motor 114, which is a driving source of the read entrance roller pair 90. The intermediate roller pair 66 includes a mechanism that determines a rotation speed in accordance with the drive of the motor that rotates at a faster rotation speed between the two motors.

In the ADF 51, when the original MS is conveyed from the registration unit C to the turning unit D by the rotation of the pullout roller pair 86 and the intermediate roller pair 66, the conveying speed in the registration unit C is set higher than the conveying seed in the first reading and conveying unit E in order to reduce the processing time for conveying the original MS to the first reading and conveying unit E. At this time, the intermediate roller pair 66 rotates by using the pullout motor 113 as the driving source.

When a read entrance sensor 67 detects the leading end of the original MS, the pullout motor 113 starts decelerating in order to adjust the conveying speed of the original MS to the conveying speed in the first reading and conveying unit E before the leading end of the original MS enters a nip formed by upper and lower rollers of the read entrance roller pair 90. At the same time, the read entrance motor 114 and the read motor 103 are driven to rotate in the forward directions. By driving the read entrance motor 114 in the forward direction, the read entrance roller pair 90 rotates in the conveying direction. By driving the read motor 103 in the forward direction, a read exit roller pair 92 and a second read exit roller pair 93 rotate in the conveying direction. When the rotation speed of the intermediate roller pair 66 due to transmission of the driving force from the read entrance motor 114 becomes faster than the rotation speed of the intermediate roller pair 66 due to transmission of the driving force from the pullout motor 113 because the read entrance roller pair 90 starts driving and the pullout motor 113 is decelerated, the intermediate roller pair 66 rotates by using the read entrance motor 114 as the driving source.

When a registration sensor 65 detects the leading end of the original MS that is conveyed from the turning unit D toward the first reading and conveying unit E, the controller 100 decelerates each of the motors over a predetermined period of time to thereby decelerate the conveying speed of the original MS over a predetermined conveying distance. The controller 100 controls to temporarily stop the original MS immediately before a first reading position 400 of the first fixed reading unit 151 and transmits a registration stop signal to the main-body control unit 111 via the I/F 107.

When receiving a read start signal from the main-body control unit 111, the controller 100 controls to drive the read entrance motor 114 and the read motor 103 so that the conveying speed of the original MS increases to reach a predetermined conveying speed before the leading end of the original, which has stopped for the registration, arrives at the first reading position 400. Accordingly, the conveying speed of the original MS is increased and the original MS is conveyed toward the first reading position 400. The controller 100 transmits a gate signal indicating an effective image area on the first surface of the original MS in the sub-scanning direction to the main-body control unit 111 at the timing which is calculated on the basis of the pulse count of the read entrance motor 114 and at which the leading end of the original MS reaches the first reading position 400. The gate signal is, continuously transmitted until the trailing end of the original MS passes through the first reading position 400, and the first surface of the original MS is read by the first fixed reading unit 151.

The original MS that has passed through the first reading and conveying unit E passes through the nip of the read exit roller pair 92, and the leading end of the original MS is detected by a discharge sensor 61. Thereafter, the original MS passes through the second reading and conveying unit F and is conveyed to the discharging unit G.

When only one side (the first surface) of the original MS is to be read, the second fixed reading unit 95 need not read the second surface of the original MS. Therefore, when the discharge sensor 61 detects the leading end of the original MS, the discharge motor 104 is driven to rotate in the forward direction, so that the discharge roller on the upper side of a discharge roller pair 94 is driven to rotate in the counterclockwise direction in the figure. Timing at which the trailing end of the original MS passes through the nip of the discharge roller pair 94 is calculated on the basis of a pulse count of the discharge motor 104 after the discharge sensor 61 detects the leading end of the original MS. The driving speed of the discharge motor 104 is decelerated immediately before the trailing end of the original MS passes through the nip of the discharge roller pair 94 on the basis of the calculation result, so that the original MS is discharged at a speed at which the original MS does not fall off the original stacking board 55.

On the other hand, when both sides of the original MS (the first surface and the second surface) are to be read, timing at which the original MS reaches the second fixed reading unit 95 after the discharge sensor 61 detects the leading end of the original MS is calculated on the basis of a pulse count of the read motor 103. At this timing, the controller 100 transmits a gate signal indicating an effective image area on the second surface of the original MS in the sub-scanning direction to the main-body control unit 111. The gate signal is continuously transmitted until the trailing end of the original MS passes through the second reading position of the second fixed reading unit 95, and the second surface of the original MS is read by the second fixed reading unit 95.

The second fixed reading unit 95 as a reading unit includes a contact image sensor (CIS). A reading surface of the second fixed reading unit 95 is coated in order to prevent vertical read lines that are generated when paste-like foreign materials attached to the original MS adheres to the reading surface. A second read roller 96 as an original supporting unit for supporting the original MS from a non-reading surface (the first surface) side is arranged at a position opposing to the second fixed reading unit 95 across a conveying path of the original MS. The second read roller 96 prevents the original MS from floating at the second reading position of the second fixed reading unit 95 and functions as a reference white unit for acquiring shading data of the second fixed reading unit 95.

In the ADF 51 according to the embodiment, a trailing-end detection sensor 60 that detects passage of the trailing end of the original MS is arranged at the same position as the separation nip in the conveying direction of the original MS. The trailing-end detection sensor 60 is a sensor that detects whether the trailing end of the original passes through the detection position by detecting presence or absence of movement of the original MS as the sheet member in the conveying direction. The details of the trailing-end detection sensor 60 will be described below.

A problem with the arrangement of a trailing-end detection sensor in a conventional ADF 51 will be described below.

Figure 15:
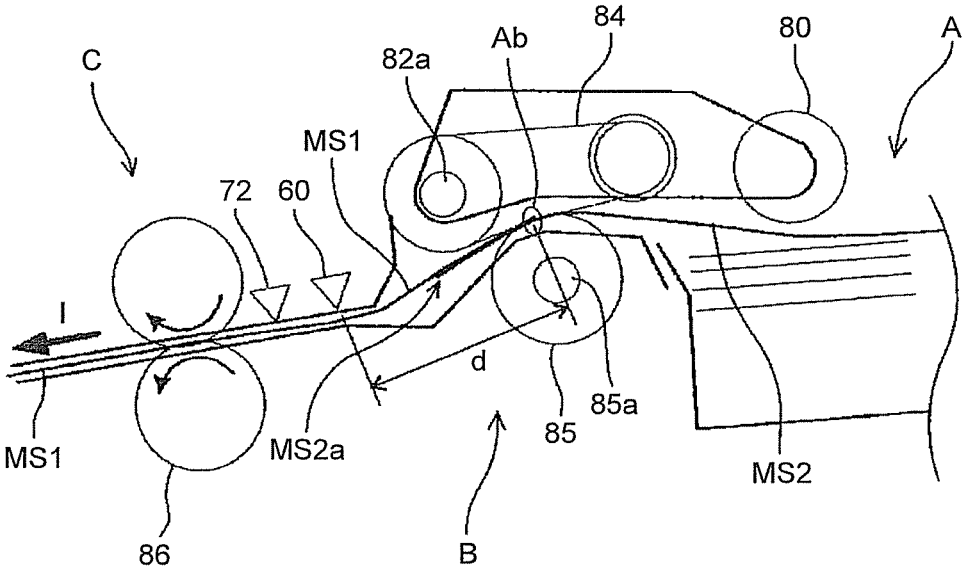
FIG. 15 is an enlarged schematic diagram of an original set unit, a separating and conveying unit, and a registration unit of a conventional ADF.

FIG. 15 is an enlarged schematic diagram of a portion near a downstream side of an original set unit A in the conveying direction, a separating and conveying unit B, and a registration unit C of the conventional ADF 51.

In FIG. 15, a state of an instance is illustrated in which, when two originals MS, i.e., a preceding original MS1 and a next original MS2, are conveyed in sequence, the trailing end of the preceding original MS1 just passes through a separation nip Ab.

The preceding original MS1 is conveyed in the conveying direction indicated by an arrow I in FIG. 15 along with the rotation of the pullout roller pair 86. While the first original MS is being conveyed, a driving source for transmitting a driving force to the feed belt 84 and the reverse roller 85 is stopped. A one-way clutch is arranged on a feed-belt drive shaft 82*a*, and, when a driving force in the feed direction (in the clockwise direction in FIG. 15) is transmitted from the shaft, the one-way clutch is locked so that the driving force is transmitted to the feed belt 84. On the other hand, when a force in the opposite direction is applied, the one-way clutch runs idle and is rotated. Therefore, when the driving force is not transmitted to the feed-belt drive shaft 82*a*, the feed belt 84 is rotated along with the conveyance of the original MS. Meanwhile, a torque limiter is arranged on a reverse roller shaft 85*a* of the reverse roller 85. Therefore, when the driving force is not transmitted to the reverse roller shaft 85*a*, and if the feed belt 84 and the reverse roller 85 come into contact with each other across one original MS, or if the feed belt 84 and the reverse roller 85 directly come into contact with each other, the reverse roller 85 rotates in the counterclockwise direction in FIG. 15 along with the rotation of the feed belt 84.

The separating and conveying unit B has the above configuration. Therefore, as illustrated in FIG. 15, if the leading end of the next original MS2 ("MS2*a*" in FIG. 15) protrudes from the separation nip Ab before the trailing end of the preceding original MS1 passes through the separation nip Ab (when the leading end of the second original is on the downstream side of the separation nip Ab in the conveying direction), the next original MS2 remains stopped at the separation nip Ab after the trailing end of the preceding original MS1 passes through the separation nip Ab. In this case, at the timing at which the driving force is transmitted to the pullout roller pair 86 and the preceding original MS1 is being conveyed, a driving force is not transmitted to the feed belt 84 and the reverse roller 85. Therefore, no action is exerted for causing the next original MS2 to return from the separation nip Ab in the direction opposite to the conveying direction. Thus, even when a trailing-end detection sensor, such as a transmissive or reflective photo sensor, is arranged at the separation nip Ab in order to detect passage of the trailing end of the preceding original MS1, when the next original MS2 is present at the separation nip Ab as illustrated in FIG. 15, it is impossible to detect the passage of the trailing end of the preceding original MS1.

Therefore, in the conventional ADF 51, as illustrated in FIG. 15, the trailing-end detection sensor 60, such as a transmissive or reflective photo sensor, is arranged at a position separated from the separation nip Ab by a predetermined distance d downstream of the separation nip Ab in order to detect the passage of the trailing end of the preceding original MS1.

The same problem also occurs for a configuration in which transmission of the driving force to the feed-belt drive shaft 82*a* is stopped and the driving force to the reverse roller shaft 85*a* is transmitted while the pullout roller pair 86 is conveying the preceding original MS1. An example of a drive mechanism corresponding to this configuration will be explained below.

A drive transmitting unit that transmits a driving force from the feed motor 102 to the pullout roller pair 86 is provided. In the drive transmitting unit that transmits a driving force to the pullout roller pair 86, a one-way clutch is arranged so that the drive transmitting unit does not transmit the driving force to the pullout roller pair 86 when the feed motor 102 rotates in the forward direction and so that the drive transmitting unit transmits the driving force to the pullout roller pair 86 when the feed motor 102 rotates in the reverse direction to convey the original MS in the conveying direction. Furthermore, in a drive transmitting unit that transmits a driving force from the feed motor 102 to the feed-belt drive shaft 82*a*, a one-way clutch is arranged so that the drive transmitting unit transmits a driving forces to rotate the feed belt 84 such that the original MS is conveyed in the conveying direction when the feed motor 102 rotates in the forward direction and so that the drive transmitting unit does not transmit a driving force to the feed-belt drive shaft 82*a* when the feed motor 102 rotates in the reverse direction.

Meanwhile, in a drive transmitting unit that transmits a driving force from the feed motor 102 to the reverse roller 85, a drive mechanism is provided that transmits a driving force to the reverse roller 85 to rotate the reverse roller 85 in the clockwise direction in the figure both when the feed motor 102 rotates in the forward direction and when the feed motor 102 rotates in the reverse direction. The drive transmitting unit of the reverse roller 85 includes a torque limiter that causes the reverse roller 85 to rotate in the direction opposite to the transmitted rotation direction when a force for rotating the reverse roller 85 in the direction opposite to the transmitted rotation direction becomes greater than a predetermined torque.

With the above drive transmitting mechanisms, it is possible to stop transmission of a driving force to the feed-belt drive shaft 82*a* and to transmit a driving force to the reverse roller shaft 85*a* while the pullout roller pair 86 is conveying the preceding original MS1.

Even in this configuration, by the setting of the torque limiter, when the feed belt 84 comes into contact with the reverse roller 85 by interposing one original MS or when the feed belt 84 directly comes into contact with the reverse roller 85, the reverse roller 85 is driven to rotate in the counterclockwise direction along with the rotation of the feed belt 84. With this setting, if the feed belt 84 is stopped and a driving force is input to the reverse roller 85 when the feed belt 84 comes into contact with the reverse roller 85 by interposing one original MS, the reverse roller 85 rotates in the direction in which the original MS is fed by the reverse roller 85 and the feed belt 84 in synchronization with the movement of the original MS being conveyed by the pullout roller pair 86 (the reverse roller 85 rotates in the counterclockwise direction). When the feed belt 84 and the reverse roller 85 come into direct contact with each other, the reverse roller 85 stops along with the stop of the feed belt 84 to which transmission of a driving force is stopped. In this state, a driving force for moving the surface in the direction opposite to the conveying direction of the original MS is input to the reverse roller 85, and a force for moving the surface in the direction opposite to the conveying direction exerts on the feed belt 84 directly or via the one original MS. However, due to the action of the one-way clutch arranged on the feed-belt drive shaft 82*a*, the surface of the feed belt 84 does not move in the direction opposite to the conveying direction but is rotated in the conveying direction or is stopped.

On the other hand, when the feed belt 84 and the reverse roller 85 come into contact with each other via two originals MS, i.e., the preceding original MS1 and the next original MS2, the reverse roller 85 rotates in the clockwise direction in the figure by a rotational driving force transmitted form the feed motor 102 and acts on the next original MS2 so that the next original MS2 returns in the direction opposite to the conveying direction. At this time, the preceding original MS1 is conveyed by the pullout roller pair 86. However, when the next original MS2 that is being conveyed in the opposite direction by the reverse roller 85 remains at the separation nip Ab when the trailing end of the preceding original MS1 passes through the separation nip Ab, the feed belt 84 and the reverse roller 85 come into contact with each other via one original MS, i.e., the next original MS2. In this state, the reverse roller 85 stops in accordance with the stop of the feed belt 84 as described above. Accordingly, the next original MS2 is stopped in the separation nip Ab after the trailing end of the preceding original MS1 passes through the separation nip Ab. Therefore, there may be an occasion in which the passage of the trailing end of the preceding original MS1 cannot be detected at the separation nip Ab even when the trailing-end detection sensor, such as a transmissive or reflective photo sensor, is arranged at the separation nip Ab.

Embodiment 1

An embodiment 1 (hereinafter, described as the first embodiment) of the ADF 51 according to the present invention, which includes the trailing-end detection sensor 60 that detects presence or absence of movement of the original MS in the conveying direction, will be explained below.

Figure 8:
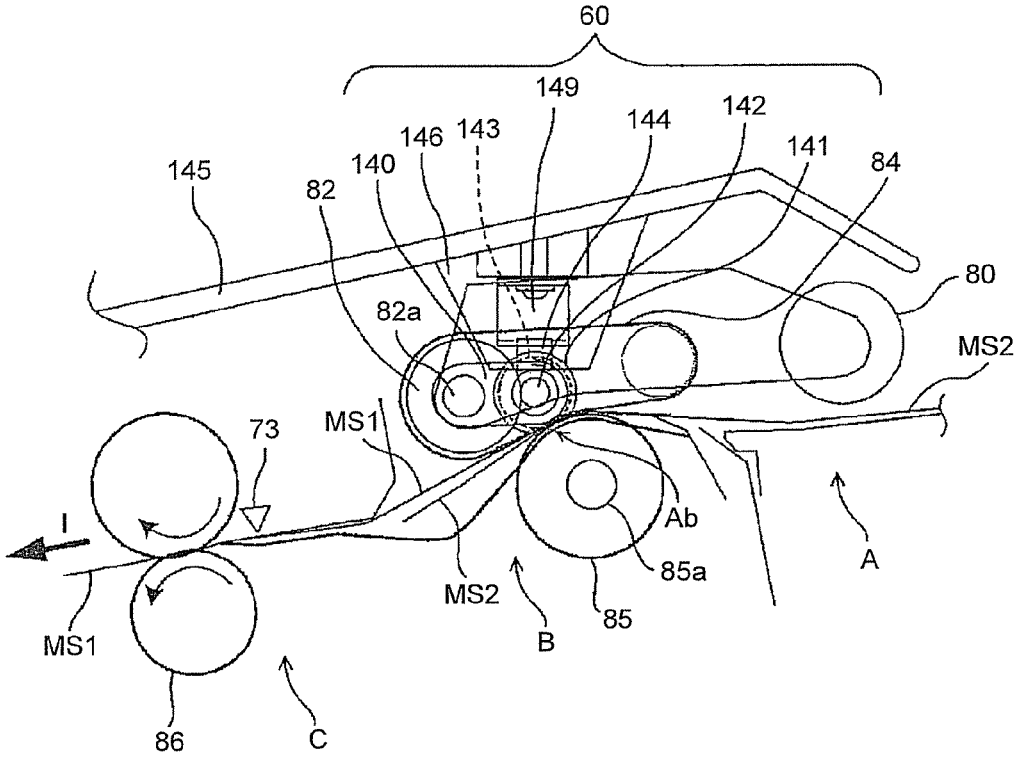
FIG. 8 is an enlarged schematic diagram of an original set unit, a separating and conveying unit, and a registration unit of the ADF according to a first embodiment.
Figure 9:
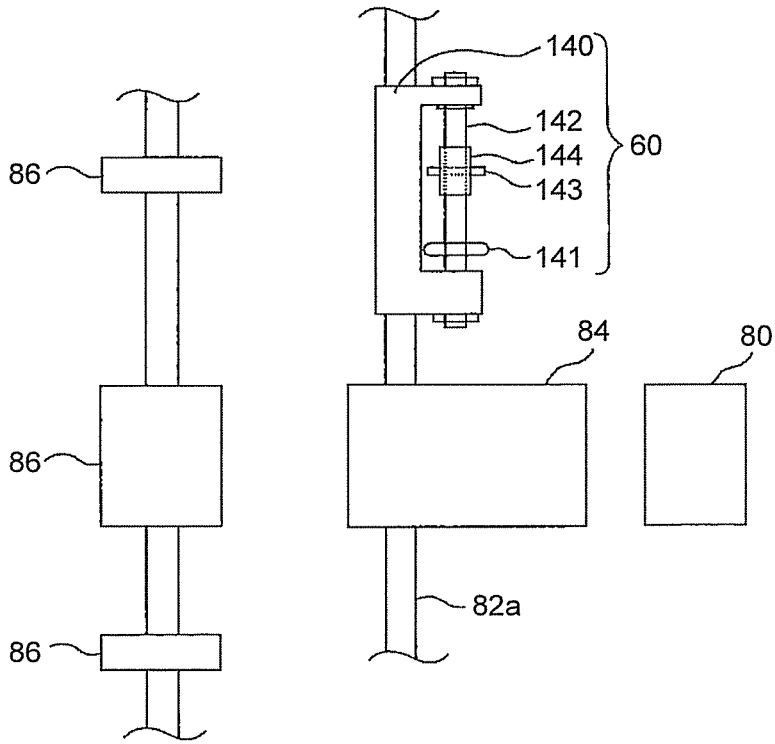
FIG. 9 is a top view of the separating and conveying unit of the ADF according to the first embodiment.
Figure 10:
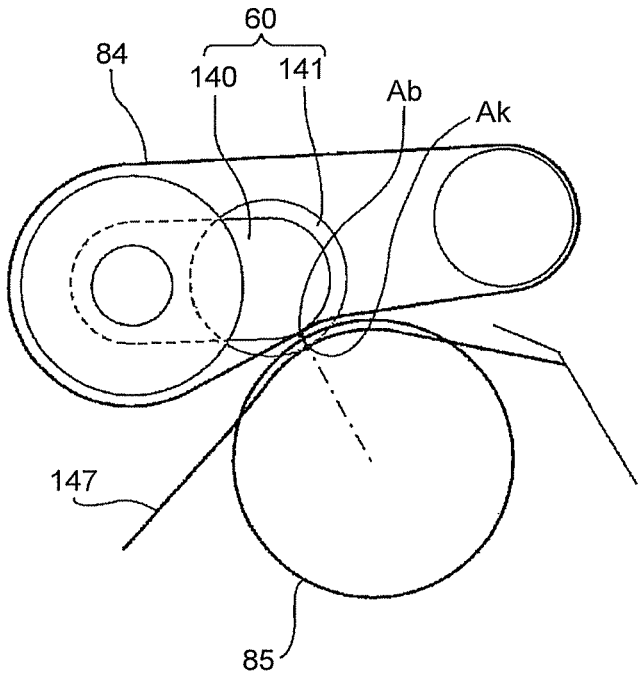
FIG. 10 is a partially enlarged view of the separating and conveying unit.
Figure 11:
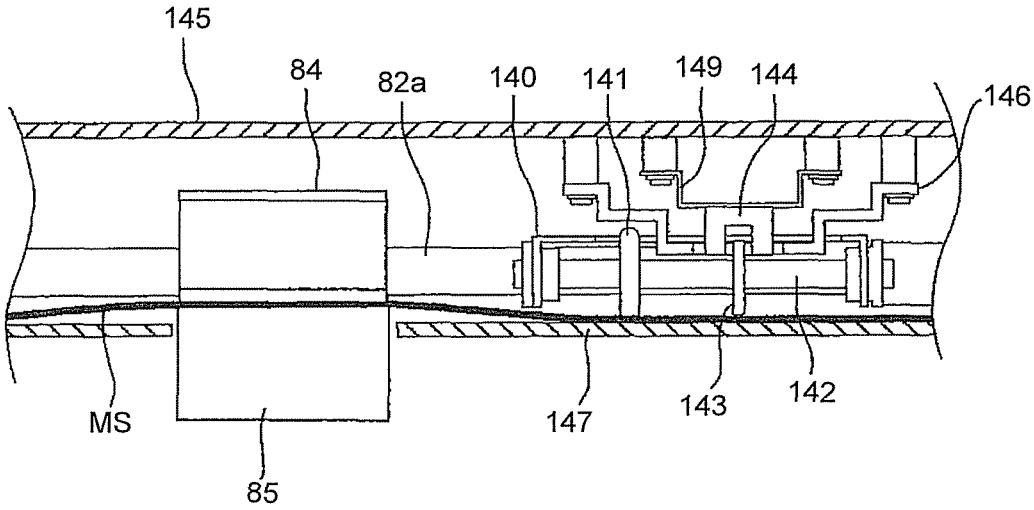
FIG. 11 is a cross-sectional view of a separation nip in the ADF according to the first embodiment, which is taken in the main-scanning direction.

FIG. 8 is an enlarged schematic diagram of a portion near a downstream side of the original set unit A in the conveying direction, the separating and conveying unit B, and the registration unit C in the ADF 51 according to the first embodiment. FIG. 9 is a top view of the separating and conveying unit B of the ADF 51 according to the first embodiment. FIG. 10 is an enlarged schematic diagram of the separating and conveying unit B illustrated in FIG. 8. FIG. 11 is a cross-sectional view of the separation nip Ab in the main-scanning direction in the ADF according to the first embodiment, when viewed from the right side of the separating and conveying unit B in FIGS. 8 and 10.

The trailing-end detection sensor 60 according to the first embodiment includes a sensor arm 140 that is rotatable about the feed-belt drive shaft 82*a* as a rotating shaft; a detection roller shaft 142 that is rotatably supported by the sensor arm 140; a detection roller 141 fitted to the detection roller shaft 142; an encoder wheel 143; a photo sensor 144; and a sensor cover 146. The photo sensor 144 and the sensor cover 146 are attached to the feeding-unit cover 145 via a sensor bracket 149.

The encoder wheel 143 is fitted to the detection roller shaft 142 so that the encoder wheel 143 rotates in synchronization with the detection roller 141. The detection roller 141 is rotatably supported by the feed-belt drive shaft 82*a* via the sensor arm 140 and comes into contact with the original MS.

A force by which the detection roller 141 comes into contact with the original MS is the weight of components supported by the sensor arm 140, such as the detection roller 141 and the detection roller shaft 142. For bringing the detection roller 141 into contact with the original MS, it is possible to apply pressure by a spring depending on a positional relation between the contact position of the detection roller 141 and the rotating shaft of the sensor arm 140.

At the timing illustrated in FIG. 8, the preceding original MS1 is sandwiched by the pullout roller pair 86 and is conveyed in the direction indicated by an arrow I in FIG. 8 along with the rotation of the pullout roller pair 86. At this time, drive of the feed motor 102 is stopped and the transmission of a driving force to the feed belt 84 and the reverse roller 85 is stopped. A drive transmitting mechanism of the feed belt 84 includes a one-way clutch on the feed-belt drive shaft 82*a*. In a drive transmitting mechanism of the reverse roller 85, a torque limiter is arranged on the reverse roller shaft 85*a*. Due to the action of the one-way clutch or the torque limiter, when the feed belt 84 and the reverse roller 85 come into contact with each other by interposing one original MS, the feed belt 84 and the reverse roller 85 rotate along with the conveyance of the original MS.

As illustrated in FIG. 10, a guide plate 147 is arranged at a position opposing to the detection roller 141 by interposing an original MS when the original MS is present at the separation nip Ab, and a detection roller nip Ak is formed due to contact between the detection roller 141 and the guide plate 147. The position of the detection roller nip Ak in the conveying direction of the original MS is near the separation nip Ab in the conveying direction. More specifically, as illustrated in FIG. 10, it is desirable that the detection roller nip Ak and the separation nip Ab are located at the same position on the extended line in the main-scanning direction (the direction perpendicular to the page of FIG. 10) (at the same positions in the conveying, direction). With this configuration, it is possible to detect that the trailing end of the preceding original MS1 passes through the separation nip Ab.

As illustrated in FIG. 11, the detection roller 141 comes into contact with the original MS. The detection roller 141 and the encoder wheel 143 are rotatable along with the movement of the original MS in the conveying direction. The encoder wheel 143 is located at a position at which light to be detected by the photo sensor 144 can be transmitted or shielded. When the original MS that is in contact with the detection roller 141 is being conveyed, the encoder wheel 143 rotates with the detection roller 141, so that the photo sensor 144 detects ON-OFF signals at regular intervals.

When the trailing end of original MS being conveyed passes through the detection roller nip Ak, the detection roller 141 and the encoder wheel 143 stop rotation, so that the photo sensor 144 detects continuous signals indicating ON or OFF. In this manner, when the signals detected by the photo sensor 144 continuously indicate ON or OFF for a predetermined period of time, it is detected that the trailing end of the preceding original MS1 passes through the separation nip Ab.

As described above, the ADF 51 of the first embodiment can detect passage of the preceding original MS1 through the separation nip Ab by detecting the movement of the original MS in the conveying direction. Therefore, as illustrated in FIG. 8, even when the next original MS2 remains at a position at which the leading end thereof protrudes from the separation nip Ab before the trailing end of the preceding original MS1 passes through the separation nip Ab, it is possible to detect the passage of the trailing end of the preceding original MS1 through the separation nip Ab. Consequently, the trailing-end detection sensor 60 of the first embodiment can detect the passage of the trailing end of the preceding original MS1 through the separation nip Ab at earlier timing than that of the trailing-end detection sensor 60 of the conventional ADF 51. Therefore, because the feed timing of the next original MS2 is controlled with reference to the detection signal of the passage of the trailing end of the preceding original MS1, it is possible to reduce intervals between sheets. The feed timing of the next original MS2 is when the pick-up roller 80 is lifted down or when the feed motor 102 starts driving.

Embodiment 2

An embodiment 2 of the ADF 51 (hereinafter, described as the second embodiment) according to the present invention, which includes the trailing-end detection sensor 60 that detects presence or absence of movement of the original MS in the conveying direction, will be explained below.

Figure 12:
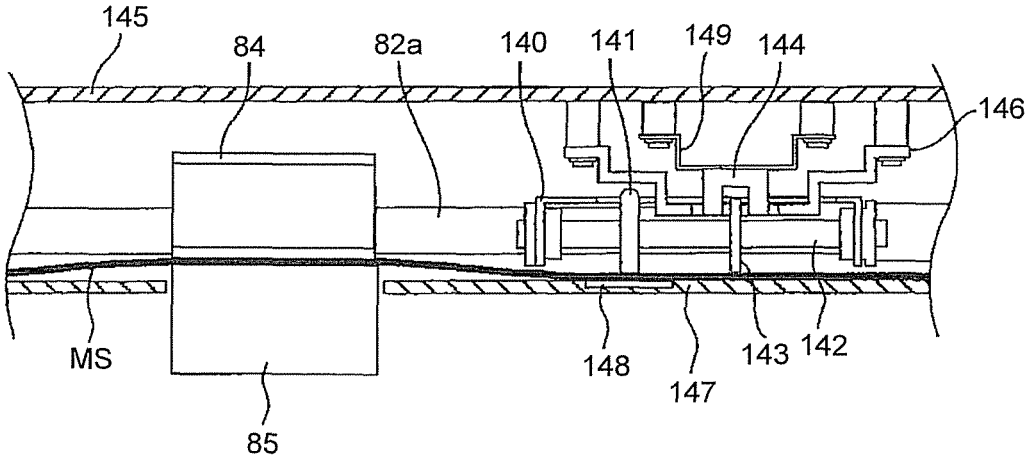
FIG. 12 is a cross-sectional view of a separation nip in an ADF according to a second embodiment, which is taken in the main-scanning direction.

FIG. 12 is a cross-sectional view of the separation nip Ab in the separating and conveying unit B of the ADF 51 according to the second embodiment, which is taken in the main-scanning direction. The ADF 51 of the second embodiment is different from the first embodiment in that it includes a friction member 148 on the guide plate 147, but other configurations are the same. Therefore, only the difference will be explained below and explanation on the common configuration will not be repeated.

In some cases, it may be difficult to convey originals one by one at the separation nip Ab, i.e., there may be no allowance for what is called multiple feeding, depending on the settings of the components included in the separating and conveying unit B. In general, frictional resistance of the reverse roller 85 against the original MS is set to be large enough in comparison to the friction force between the originals MS. However, a coefficient of friction of the surface of the reverse roller 85 may be reduced and the frictional resistance against the original MS may be reduced accordingly due to a change in the property of the surface of the reverse roller 85 over time.

In the ADF 51 of the first embodiment, a component opposing to the detection roller 141 is the guide plate 147. When two originals MS enter the separation nip Ab, a force that is obtained by "a pressing force×{(a coefficient of friction between the originals MS)−(a coefficient of friction between the original MS and the guide plate 147)} is used as a conveying force on the next original MS2, so that multiple feeding is accelerated.

On the other hand, the ADF 51 of the second embodiment includes the friction member 148 having a greater coefficient of friction with the original MS than that with the guide plate 147. Therefore, a value corresponding to "the coefficient of friction between the original MS and the guide plate 147" in the above expression increases. As a result, the value of the force obtained by the above expression is reduced, so that the conveying force applied to the next original MS2 is reduced compared to that of the first embodiment. Therefore, it is possible to reduce the possibility of multiple feeding.

A configuration example of a combination of components that move together with the feeding-unit cover 145 along with an open/close operation of the feeding-unit cover 145 will be explained below.

Figure 13:
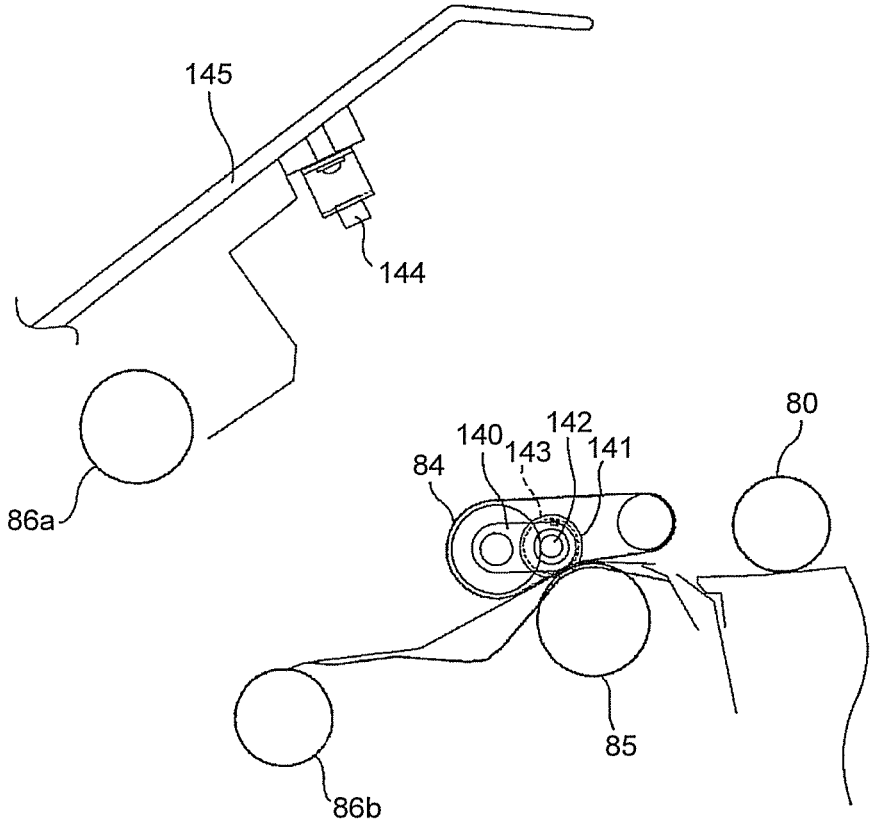
FIG. 13 is an explanatory diagram of a first configuration example of a combination of components that move together with a feeding-unit cover.

FIG. 13 is an explanatory diagram of a first configuration example of the combination of the components that move together with the feeding-unit cover 145.

In the configuration example illustrated in FIG. 13, the photo sensor 144 is arranged on the feeding-unit cover 145 that is rotatably supported by the main body of the ADF 51. In this configuration example, as illustrated in FIG. 13, the operability for replacing the photo sensor 144 is good because the feeding-unit cover 145 can be opened adequately.

Figure 14:
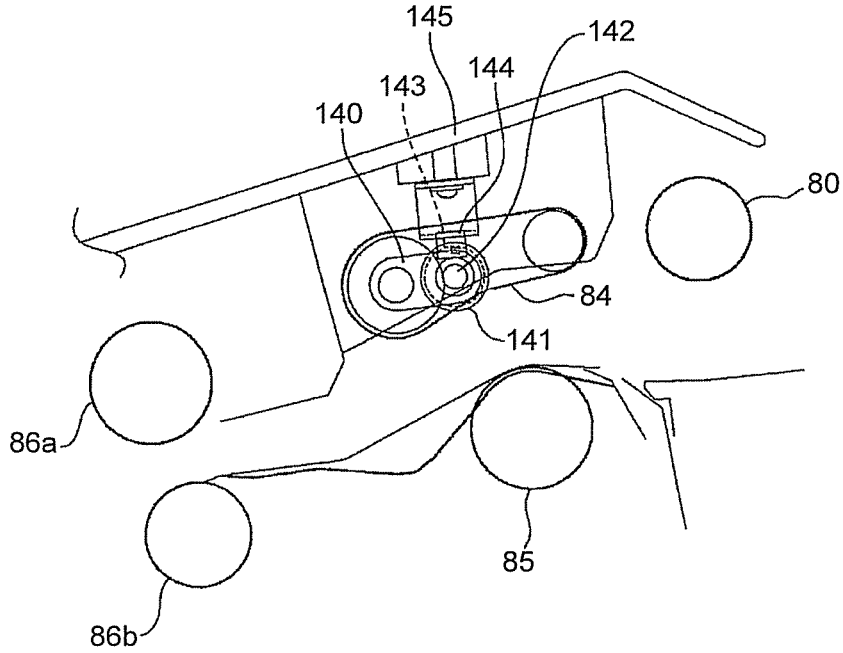
FIG. 14 is an explanatory diagram of a second configuration example of the combination of the components that move together with the feeding-unit cover.

In a configuration example illustrated in FIG. 14, components that form the trailing-end detection sensor 60, the feed belt 84, and the pick-up roller 80 are supported by the feeding-unit cover 145 that is rotatably supported by the main body of the ADF 51. In this configuration example, as illustrated in FIG. 14, a conveying path of the original MS near the separation nip Ab is exposed by opening the feeding-unit cover 145, so that it is possible to remove a stuck original MS without any damage when a paper jam occurs.

As described above, the ADF 51 as the sheet conveying apparatus according to the embodiment includes the original set unit A, the original conveying unit 54, the pick-up roller 80, and the separating and conveying unit B. The original set unit A is a sheet housing unit for housing a plurality of originals MS, which are sheet members, in a stacked manner. The original conveying unit 54 is a sheet conveying unit that conveys the originals MS to a predetermined conveyance target position. The pick-up roller 80 forms a sheet pick-up unit that applies a conveying force in a direction toward the original conveying unit 54 side to the topmost original MS, which is one outermost sheet in the stack of the originals MS on the original support plate 53, to thereby pick up the topmost original MS from the originals MS. The separating and conveying unit B is a separating and conveying means that separates one original MS from the other originals MS, which are conveyed toward the original conveying unit 54 and overlap with the one original MS to which the conveying force is applied by the pick-up roller 80, and conveys only the one original MS to the original conveying unit 54. In the ADF 51 described above, the trailing-end detection sensor 60 that is a sheet-conveyance-movement detecting means for detecting presence or absence of movement of the original MS in the conveying direction is provided at a position, which is the same as or near the position of the separation nip Ab in the conveying direction of the original MS and at which the preceding original MS1 and the next original MS2 partly overlap each other, where the separation nip Ab is a separation portion being an area in which the separation action of the separating and conveying unit B works.

In the first embodiment, the rotatably-supported detection roller 141 comes into contact with the original MS being conveyed, and the movement of the original MS can be detected by detecting presence or absence of the rotation of the detection roller 141 that rotates in synchronization with the movement of the original MS at the same position as the separation nip Ab in the conveying direction. Therefore, even when the leading end of the next original MS2 protrudes from the separation nip Ab toward the downstream side in the conveying direction at the same time the trailing end of the first original MS passes through the separation nip Ab, it is possible to detect passage of the trailing end of the preceding original MS1 through the separation nip Ab. Therefore, it is possible to arrange the trailing-end detection sensor 60 at the same position as or near the position of the separation nip Ab in the conveying direction of the original MS. As a result, it is possible to detect the passage of the trailing end of the preceding original MS1 through the separation nip Ab at earlier timing, enabling to ensure the high productivity.

The separating and conveying unit B of the ADF 51 includes the feed belt 84 and the reverse roller 85. The feed belt 84 is a conveying belt having a surface that endlessly moves and that comes into contact with a top surface of one original MS to apply a conveying force in the conveying direction to the one original MS. The reverse roller 85 comes into contact with the feed belt 84 to form the separation nip Ab as the separation portion and receives a driving force for moving the surface of the reverse roller 85 in the direction opposite to the direction of the surface movement of the feed belt 84. The reverse roller 85 is a roller that includes a torque limiter in the drive transmitting mechanism and that prevents multiple feeding by rotating along with the surface movement of the feed belt 84 when the surface of the reverse roller 85 comes into direct contact with the feed belt 84 or comes into contact with the feed belt 84 by interposing one original MS. By forming the separation nip Ab with the feed belt 84 and the reverse roller 85 as described above, it is possible to realize the configuration in which the next original MS2, which is one of the other originals that are conveyed toward the original conveying unit 54 and overlap with the preceding original MS1 to which the conveying force is applied by the pick-up roller 80, can be separated from the preceding original MS1 and only the preceding original MS1 can be convened to the original conveying unit 54.

The trailing-end detection sensor 60 as the sheet-conveyance-movement detecting unit of the ADF 51 can detect presence or absence of movement of the original MS in the conveying direction by using the detection roller 141 that is a contact detecting member for detecting movement of the original MS by coming into contact with the original MS.

The detection roller 141 as the contact detecting member in the ADF 51 is a rotary member that rotates along with the movement of the original MS in contact therewith in the conveying direction. By detecting the rotation of the detection roller 141, it is possible to detect presence or absence of the movement of the original MS in the conveying direction at the detection roller nip Ak being the detection position.

The trailing-end detection sensor 60 of the ADF 51 includes the photo sensor 144 that is an optical sensor for detecting presence or absence of the rotation of the detection roller 141; and the guide plate 147 as a sheet guide member that comes into contact with the detection roller 141 by interposing the original MS while the detection roller 141 is in contact with the original MS. The detection roller 141 is a rotatable member that is rotatably supported so as to come into contact with the original MS and that rotates along with the movement of the original MS. The photo sensor 144 detects the rotation state of the encoder wheel 143 that rotates together with the detection roller 141, thereby detecting presence or absence of the rotation of the detection roller 141.

In the embodiments described above, explanations are given to a configuration in which the guide plate 147 functions as a sheet guide member that comes into contact with the detection roller 141. However, the sheet guide member that comes into contact with the detection roller 141 may be a roller member that is rotatably supported and that rotates along with the movement of the original MS sandwiched between the sheet guide member and the detection roller 141.

The ADF 51 includes the feeding-unit cover 145 that is a cover member that opens and closes with respect to the main body of the ADF 51 and that exposes the conveying path of the original MS in or near the separation nip Ab when opened. In the configuration example illustrated in FIG. 14, the feed belt 84 and the trailing-end detection sensor 60 are supported by the feeding-unit cover 145. In this configuration example, as illustrated in FIG. 14, when the feeding-unit cover 145 is opened, the conveying path of the original MS in or near the separation nip Ab is exposed, so that it is possible to remove a stuck original MS without any damage when a paper jam occurs.

In the configuration example of the feeding-unit cover 145 of the ADF 51 as illustrated in FIG. 13, the photo sensor 144 included in the trailing-end detection sensor 60 is supported by the feeding-unit cover 145. In this configuration example, as illustrated in FIG. 13, because the feeding-unit cover 145 can be opened adequately, the operability for replacing the photo sensor 144 is good.

The ADF 51 includes the feed motor 102 as a driving unit for driving the feed belt 84 and the reverse roller 85, which form the separating and conveying unit B, and the pick-up roller 80 as a sheet pick-up means. The controller 100 as a control unit of the ADF 51 refers to a detection signal, which indicates passage of the trailing end of the one original MS through the detection position of the trailing-end detection sensor 60, on the basis of the detection result of the trailing-end detection sensor 60, and thereafter controls drive of the feed motor 102. The drive start timing of the feed motor 102 for feeding the next original MS2 is controlled on the basis of the detection of the trailing end of the preceding original MS1 by the trailing-end detection sensor 60 at the detection roller nip Ak that is located at the same position as the separation nip Ab in the conveying direction of the original MS. Therefore, it is possible to reduce intervals between the sheets.

The sheet pick-up unit of the ADF 51 includes the pick-up roller 80 as the sheet pick-up member that operates while being in contact with the topmost one of the originals MS stacked on the original support plate 53 to thereby apply a conveying force to the topmost original MS; and a pick-up contacting separating mechanism (not illustrated) as a sheet pick-up-member contacting separating mechanism for causing the pick-up roller 80 to come into contact with or separate from the originals MS placed on the original support plate 53. The sheet pick-up unit also includes the feed motor 102 for transmitting a rotational driving force to the pick-up roller 80; and the pick-up elevator motor 101 for transmitting a driving force to the pick-up contacting separating mechanism to lift up or lift down the pick-up roller 80. When the sheet pick-up unit receives a call start signal, the pick-up contacting separating mechanism drives the pick-up elevator motor 101 to bring the pick-up roller 80 into contact with the original MS placed on the original support plate 53, so that the state of the pick-up roller 80 is changed from a "separation" state to a "contact" state. Thereafter, the feed motor 102 is driven to drive the pick-up roller 80 that is in contact with the original MS. That is, in the ADF 51, the pick-up roller 80 is separated from the original MS every time one original MS is conveyed; the pick-up roller 80 is lifted down in accordance with a predetermined trigger for conveying a next original MS; and thereafter the pick-up roller 80 is started to rotate. In this configuration, with the predetermined trigger, detecting the trailing end of the preceding original MS1 by the trailing-end detection sensor 60 at the same position as the position of the separation nip Ab in the conveying direction of the original MS, it is possible to reduce the intervals between sheets, enabling to improve the productivity in continuous conveyance of the originals MS.

The image reading unit 50 as an image reading apparatus includes an original conveying unit for conveying the original MS, which is a sheet member, and the first fixed reading unit 151 and the second fixed reading unit 95 that are reading means for reading original images from the originals MS conveyed by the original conveying unit. In the image reading unit 50, the ADF 51 of the embodiments is used as the original conveying unit. Therefore, it is possible to reduce the intervals between the originals MS being conveyed, enabling to increase the productivity in continuous reading of the originals.

The copying machine 500 as an image forming apparatus includes an image reading unit and the image forming unit 1 as an image forming means for forming an image on the basis of the original image read by the image reading unit. In the copying machine 500, the image reading unit 50 of the embodiments is used as the image reading means. Therefore, it is possible to increase the productivity in continuous reading of the originals, enabling to increase the productivity in continuous copying.

In the separation portion, a conveying force in the conveying direction is applied only to a preceding sheet between two successive sheets being conveyed (described as a preceding sheet and a next sheet), and a conveying force in the direction opposite to the conveying direction or a stopping force is exerted to the next sheet.

When a sheet that is conveyed in the conveying direction is present at a detection position that is the same as or near the separating unit in the conveying direction of the sheet, the sheet-conveyance-movement detecting unit detects presence of the sheet that is being conveyed in the conveying direction at the detection position. On the other hand, when the preceding sheet is not present but the next sheet is present at the detection position, because a conveying force in the direction opposite to the conveying direction or a stopping force is exerted to the next sheet, the sheet-conveyance-movement detecting unit detects absence of any sheet that is being conveyed in the conveying direction at the detection position. Furthermore, when no sheet is present at the detection position, the sheet-conveyance-movement detecting unit detects absence of any sheet that is being conveyed in the conveying direction at the detection position.

Therefore, while the sheet-conveyance-movement detecting unit is detecting a sheet being conveyed in the conveying direction, it is possible to detect that the preceding sheet is passing through the detection position. After the trailing end of the preceding sheet passes through the detection position, the sheet-conveyance-movement detecting unit detects absence of any sheet that is being conveyed in the conveying direction, thereby detecting that the trailing end of the preceding sheet has passed through the detection position. By using such a sheet-conveyance-movement detecting unit, it is possible to detect the passage of the trailing end of the preceding sheet at the position, which is the same as or near the separating unit in the conveying direction of the sheet and even at which the preceding sheet and the next sheet may overlap each other.

Furthermore, the sheet-conveyance-movement detecting unit is arranged downstream of the pick-up position at which the sheet pick-up unit picks up one sheet. Therefore, it is not necessary to arrange a sheet-trailing-end detecting unit in the sheet housing unit, so that the sheet setting capacity of the sheet housing unit is not reduced.

According to one aspect of the present invention, it is possible to detect passage of the trailing end of a sheet through a predetermined position, at a position which is the same as or near the position of the separating unit in the conveying direction of the sheet and at which two sheets that are successively conveyed may overlap each other. Therefore, it is possible to detect the passage of the trailing end of a sheet through the predetermined position at earlier timing than the timing in the conventional technology, without any degradation in the sheet setting capability of the sheet housing unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus, comprising:

a sheet housing unit that houses a plurality of sheets in a stacked manner;

a sheet conveying unit that conveys a sheet;

a sheet pick-up unit that picks up, at a pick-up position, an outermost one of the sheets housed in the sheet housing unit by applying a conveying force to the outermost sheet for conveying the outermost sheet to a sheet conveying unit side;

a separating and conveying unit that, when a next sheet is conveyed to the sheet conveying unit and overlaps with the outermost sheet to which the conveying force is applied by the sheet pick-up unit, separates the next sheet from the outermost sheet by applying a conveying force in a direction opposite to a sheet conveying direction to the next sheet or by applying a stopping force to the next sheet, and conveys only the outermost sheet to the sheet conveying unit;

a sheet-conveyance-movement detecting unit that detects presence or absence of movement of a sheet in the conveying direction, wherein:

the sheet-conveyance-movement detecting unit is arranged at a position same as or near a separation portion in the conveying direction, opposing to the separating and conveying unit, the sheet-conveyance-movement detecting unit and the separating and conveying unit define a separation nip through which sheets are conveyed, and the separation portion is located downstream of the pick-up position, and is an area where a separation action of the separating and conveying unit works; and a guide plate which is arranged at a position opposing a roller on the sheet-conveyance-movement detecting unit by interposing an original sheet when the original sheet is present at the separation nip, the guide plate includes a friction member on a surface thereof opposing the roller on the sheet-conveyance-movement detecting unit, wherein a coefficient of friction between the original sheet and the friction member is greater as compared to a coefficient of friction between the original sheet and the guide plate.

2. The sheet conveying apparatus according to claim 1, wherein the separating and conveying unit includes a conveying belt having a surface that endlessly moves and that comes into contact with a top surface of the outermost sheet to apply a conveying force in the conveying direction to the top surface; and a multiple feeding preventive roller that receives a driving force for moving a surface thereof in a direction opposite to a direction of a surface movement of the conveying belt and that rotates along with the surface movement of the conveying belt when the surface thereof directly comes into contact with the conveying belt or when the surface thereof comes into contact with the conveying belt by interposing one sheet.

3. The sheet conveying apparatus according to claim 1, wherein the sheet-conveyance-movement detecting unit includes the roller that detects movement of a sheet by coming into contact with the sheet.

4. The sheet conveying apparatus according to claim 3, wherein the roller is a rotary member that rotates along with rotation of the sheet in contact therewith in the conveying direction, and the sheet-conveyance-movement detecting unit detects presence or absence of movement of the sheet in the conveying direction by detecting rotation of the rotary member.

5. The sheet conveying apparatus according to claim 4, wherein the sheet-conveyance-movement detecting unit includes an optical sensor that detects presence or absence of the rotation of the rotary member; and the guide plate that comes into contact with the rotary member by interposing a sheet while the rotary member is in contact with the sheet.

6. The sheet conveying apparatus according to claim 2, further comprising:

a cover member that opens and closes with respect to a main body of the sheet conveying apparatus and that exposes a conveying path of a sheet in the separation portion and near the separation portion when opened, wherein the conveying belt and the sheet-conveyance-movement detecting unit are supported by the cover member.

7. The sheet conveying apparatus according to claim 3, further comprising:

a cover member that opens and closes with respect to a main body of the sheet conveying apparatus and that exposes a conveying path of a sheet in the separation portion and near the separation portion when opened, wherein a conveying belt in the separating and conveying unit and the sheet-conveyance-movement detecting unit are supported by the cover member.

8. The sheet conveying apparatus according to claim 1, further comprising:

a cover member that opens and closes with respect to a main body of the sheet conveying apparatus and that exposes a conveying path of a sheet in the separation portion and near the separation portion when opened, wherein at least a part of a component included in the sheet-conveyance-movement detecting unit is supported by the cover member.

9. The sheet conveying apparatus according to claim 1, further comprising:

a driving unit that drives the separating and conveying unit and the sheet pick-up unit, wherein the driving unit operates in accordance with a detection signal indicating that the sheet-conveyance-movement detecting unit has detected passage of a trailing end of the outermost sheet through the detection position, on the basis of a detection result of the sheet-conveyance-movement detecting unit.

10. The sheet conveying apparatus according to claim 1, wherein the sheet pick-up unit includes a sheet pick-up member that operates while being in contact with the outermost one of the sheets stacked and housed in the sheet housing unit to thereby apply a conveying force to the outermost sheet; and a sheet pick-up-member contacting separating mechanism that causes the sheet pick-up member to come into contact with or separate from a sheet in the sheet housing unit, wherein the sheet pick-up-member contacting separating mechanism controls contact and separation of the sheet pick-up member with reference to a detection signal indicating that the sheet-conveyance-movement detecting unit has detected passage of a trailing end of the outermost sheet through the detection position, on the basis of a detection result of the sheet-conveyance-movement detecting unit.

11. An image reading apparatus, comprising:

a sheet conveying unit that conveys an original as a sheet; and an image reading unit that reads an original image on a sheet original, wherein the sheet conveying unit includes:

a sheet housing unit that houses a plurality of sheets in a stacked manner;

a sheet conveying unit that conveys a sheet;

a sheet pick-up unit that picks up, at a pick-up position, an outermost one of the sheets housed in the sheet housing unit by applying a conveying force to the outermost sheet for conveying the outermost sheet to a sheet conveying unit side;

a separating and conveying unit that, when a next sheet is conveyed to the sheet conveying unit and overlaps with the outermost sheet to which the conveying force is applied by the sheet pick-up unit, separates the next sheet from the outermost sheet by applying a conveying force in a direction opposite to a sheet conveying direction to the next sheet or by applying a stopping force to the next sheet, and conveys only the outermost sheet to the sheet conveying unit;

a sheet-conveyance-movement detecting unit that detects presence or absence of movement of a sheet in the conveying direction, wherein:

the sheet-conveyance-movement detecting unit is arranged at a position same as or near a separation portion in the conveying direction, opposing to the separating and conveying unit, the sheet-conveyance-movement detecting unit and the separating and conveying unit define a separation nip through which sheets are conveyed, and the separation portion is located downstream of the pick-up position, and is an area where a separation action of the separating and conveying unit works; and a guide plate which is arranged at a position opposing a roller on the sheet-conveyance-movement detecting unit by interposing an original sheet when the original sheet is present at the separation nip, the guide plate includes a friction member on a surface thereof opposing the roller on the sheet-conveyance-movement detecting unit, wherein a coefficient of friction between the original sheet and the friction member is greater as compared to a coefficient of friction between the original sheet and the guide plate.

12. An image forming apparatus comprising:

the image reading apparatus according to claim 11; and an image forming unit that forms an image on the basis of the original image read by the image reading unit.

* * * * *